US011418273B2

(12) United States Patent
Yamagishi et al.

(10) Patent No.: US 11,418,273 B2
(45) Date of Patent: Aug. 16, 2022

(54) RECEPTION DEVICE, TRANSMISSION DEVICE, AND DATA PROCESSING METHOD

(71) Applicant: SATURN LICENSING LLC, New York, NY (US)

(72) Inventors: Yasuaki Yamagishi, Kanagawa (JP); Tatsuya Igarashi, Tokyo (JP); Norifumi Kikkawa, Tokyo (JP); Yoshiharu Dewa, Tokyo (JP)

(73) Assignee: SATURN LICENSING LLC, New York, NY (US)

( * ) Notice: Subject to any disclaimer, the term of this patent is extended or adjusted under 35 U.S.C. 154(b) by 0 days.

(21) Appl. No.: 15/521,105

(22) PCT Filed: Oct. 21, 2015

(86) PCT No.: PCT/JP2015/079644
§ 371 (c)(1),
(2) Date: Apr. 21, 2017

(87) PCT Pub. No.: WO2016/067987
PCT Pub. Date: May 6, 2016

(65) Prior Publication Data

US 2017/0353253 A1 Dec. 7, 2017

(30) Foreign Application Priority Data

Oct. 28, 2014 (JP) ..... JP2014-219658

(51) Int. Cl.
*H04H 60/15* (2008.01)
*H04H 60/17* (2008.01)
*H04H 20/24* (2008.01)

(52) U.S. Cl.
CPC ..... *H04H 60/15* (2013.01); *H04H 60/17* (2013.01); *H04H 20/24* (2013.01)

(58) Field of Classification Search
CPC ..... H04N 21/4355; H04N 21/262; H04N 21/4358; H04N 21/4755; H04L 12/18;
(Continued)

(56) References Cited

U.S. PATENT DOCUMENTS 8,458,467 B2 6/2013 Dashora et al.
8,660,123 B2 2/2014 Murai et al.
(Continued)

FOREIGN PATENT DOCUMENTS

CN 101072173 A 11/2007
CN 101433089 A 5/2009
(Continued)

OTHER PUBLICATIONS

"Data Coding and Transmission Specification for Digital Broadcasting", ARIB Standard, ARIB STD-B24, Version 5.8, vol. 3, Jul. 2013, pp. 82-86.
(Continued)

*Primary Examiner* — Ngoc K Vu
(74) *Attorney, Agent, or Firm* — Jeffery J Brosemer

(57) ABSTRACT

A configuration in which a reception device can determine whether or not data reception via a network is permitted on the basis of signaling data is implemented. A class identifier indicating a group of reception devices or users that are permitted to perform data reception via a network is recorded in signaling data transmitted from a transmission device to a reception device. A reception device determines whether or not a class identifier is identical to a class identifier set to a reception device or a user and performs data reception via a network when the class identifiers are identical to each other. A URL base pattern applied to data reception via a broadcast wave or a network is recorded in signaling data, and a reception device performs data acquisition to which the URL base pattern is applied.

19 Claims, 31 Drawing Sheets

(58) Field of Classification Search
CPC ..... H04L 12/185; H04L 45/16; H04L 49/201; H04L 61/00; H04L 61/6063; H04L 61/6068; H04L 61/6086; H04H 60/15; H04H 60/17; H04H 60/76; H04H 60/45; H04H 20/24
See application file for complete search history.

(56) References Cited

U.S. PATENT DOCUMENTS

| | | | | |
|---|---|---|---|---|
| 9,497,180 | B2 * | 11/2016 | Oyman | H04L 63/10 |
| 2007/0156919 | A1 * | 7/2007 | Potti | G06F 8/656 709/238 |
| 2008/0130518 | A1 | 6/2008 | Nishikata et al. | |
| 2008/0201746 | A1 | 8/2008 | Xu et al. | |
| 2009/0274151 | A1 | 11/2009 | Murai et al. | |
| 2011/0202966 | A1 * | 8/2011 | Gupta | H04N 21/235 725/114 |
| 2012/0263035 | A1 * | 10/2012 | Nakanishi | H04L 45/02 370/225 |
| 2014/0201323 | A1 * | 7/2014 | Fall | H04L 65/4084 709/217 |
| 2014/0372624 | A1 * | 12/2014 | Wang | H04L 69/18 709/231 |
| 2015/0012584 | A1 * | 1/2015 | Lo | H04L 67/02 709/203 |
| 2015/0327025 | A1 | 11/2015 | Yamagishi | |
| 2016/0353136 | A1 * | 12/2016 | Lee | H04N 21/43 |

FOREIGN PATENT DOCUMENTS

| | | | |
|---|---|---|---|
| CN | 102771133 | A | 11/2012 |
| JP | 2014-057227 | A | 3/2014 |
| KR | 100462825 | B1 | 12/2004 |
| WO | WO 2005/050992 | A1 | 6/2005 |
| WO | 2008/032371 | A1 | 3/2008 |
| WO | 2013/052255 | A1 | 4/2013 |
| WO | WO 2014/132821 | A1 | 9/2014 |

OTHER PUBLICATIONS

Data Coding and Transmission Specification for Digital Broadcasting, ARIB Standard, ARIB STD-B24 Version 5.8, Fascicle 3, Jul. 2013, p. 82-86.
Extended European Search Report dated May 2, 2018 in corresponding European Patent Application No. 15855667.0, 9 pages.
Notification of Reasons for Refusal for JP2016-556515, dated Apr. 24, 2019. English translation provided.
Data Coding and Transmission Specification for Digital Broadcasting, ARIB STD-B24 Standards (Fascicle 3), [online], Association of Radio Industries and Businesses, Jul. 2013, Edition 5.8, p. 82-86NPL Internet <URL: http://www.arib.or.jp/english/html/overview/doc/2-STD-B.
Office Action dated Aug. 6, 2019 in Japanese Patent Application No. 2016-556515 (with English translation).
Combined Chinese Office Action and Search Report dated Jul. 3, 2019 in Chinese Patent Application No. 201580057358.0 (with English translation), 16 pages.

* cited by examiner

FIG. 24(1)

CASE OF DELIVERY VIA BROADCASTING

USD bundleDescription/
userServiceDescription/
deliveryMehod/
r12:broadcastAppService/
basePattern(http://a.com/)

TARGET FILE

FILE url=http://a.com/x.js

FIG. 24(2)

CASE OF DELIVERY VIA NETWORK

USD bundleDescription/
userServiceDescription/
deliveryMehod/
r12:broadcastAppService/
basePattern(http://a.com/)
r12:unicastAppService/
basePattern(http://a.com/)

TARGET FILE

FILE url=http://a.com/x.js

RECEPTION DEVICE, TRANSMISSION DEVICE, AND DATA PROCESSING METHOD

CROSS REFERENCE TO RELATED APPLICATIONS

This application is a U.S. National Phase of International Patent Application No. PCT/JP2015/079644 filed on Oct. 21, 2015, which claims priority benefit of Japanese Patent Application No. JP 2014-219658 filed in the Japan Patent Office on Oct. 28, 2014. Each of the above-referenced applications is hereby incorporated herein by reference in its entirety.

TECHNICAL FIELD

The present disclosure relates to a reception device, a transmission device, and a data processing method. More particularly, the present disclosure relates to a reception device that performs reception of data, for example, via a broadcast wave or a network, a transmission device that perform transmission of data, for example, via a broadcast wave or a network, and a data processing method for communication data.

BACKGROUND ART

Development and standardization of systems in which transmission and reception of content such as broadcast programs through one-way communication using a broadcast wave or the like or two-way or one-way communication via a network such as the Internet or the like are performed between a transmission device that provides content such as a broadcast station or a content server and a reception device such as a television, a PC, or a mobile terminal has been actively conducted.

Note that a related art such that a technique of implementing data delivery via a broadcast wave and a network is disclosed in, for example, Patent Document 1 (Japanese Patent Application Laid-Open No. 2014-057227).

Standardization of Advanced Television System Committee (ATSC) 3.0 has been conducted as one of standards related to data delivery system via a broadcast wave and a network.

In ATSC 3.0, a packaging scheme for download type application delivery management and an offline application registration/update management scheme are still under review.

Meanwhile, World Wide Web Consortium (W3C) which is an international standardization organization of World Wide Web (WWW) usage technology is developing a specification of a service worker (SW) including a control program or the like used to realize use of applications convenient for clients.

In order to realize effective use of a framework of the service worker (SW) in clients which are reception devices of broadcast content, it is required that delivery management of application parts which are broadcast and delivered and the service worker (SW) can be effectively managed.

CITATION LIST

Patent Document

Patent Document 1: Japanese Patent Application Laid-Open No. 2014-057227

SUMMARY OF THE INVENTION

Problems to be Solved by the Invention

It is an object of the present disclosure to provide a reception device, a transmission device, and a data processing method, which are capable of realizing the effective use of the service worker (SW) framework in clients serving as a broadcast content reception device.

Further, specifically, it is an object to provide a reception device, a transmission device, and a data processing method, which are capable of implementing, for example, delivery control using control information applied to a determination process of determining whether data acquisition in a reception device is performed via broadcasting or via a network.

Solutions to Problems

According to a first aspect of the present disclosure, provided is a reception device, including a data processing unit that receives signaling data in which class information indicating a group of reception devices or users that are permitted to perform data reception via a network is recorded and determines whether the data reception is performed via broadcasting or via a network according to the class information.

Further, according to a second aspect of the present disclosure, provided is a transmission device that transmits signaling data in which class information indicating a group of reception devices or users that are permitted to perform data reception via a network is recorded.

Further, according to a third aspect of the present disclosure, provided is a data processing method performed in a reception device, including:

receiving, by a communication unit, signaling data in which class information indicating a group of reception devices or users that are permitted to perform data reception via a network is recorded; and determining, by a data processing unit, whether the data reception is performed via broadcasting or via a network according to the class information.

Further, according to a fourth aspect of the present disclosure, provided is a data processing method performed in a transmission device, including:

transmitting signaling data in which class information indicating a group of reception devices or users that are permitted to perform data reception via a network is recorded.

Other objects, features, and advantages of the present disclosure will become apparent from detailed description based on an embodiment of the present disclosure to be described later and the attached drawings. Note that, in this specification, a system is a logical aggregate configuration of a plurality of devices, and it is not limited to a configuration in which devices of respective components are in the same housing.

Effects of the Invention

According to a configuration of an embodiment of the present disclosure, a configuration in which a reception device can determine whether or not data reception via a network is permitted on the basis of signaling data is implemented.

Specifically, for example, a class identifier indicating a group of reception devices or users that are permitted to perform data reception via a network is recorded in signaling data transmitted from a transmission device to a reception device. A reception device determines whether or not a class identifier is identical to a class identifier set to a reception device or a user and performs data reception via a network when the class identifiers are identical to each other. A URL base pattern applied to data reception via a broadcast wave or a network is recorded in signaling data, and a reception device performs data acquisition to which the URL base pattern is applied.

According to the present configuration, a configuration in which a reception device can determine whether or not data reception via a network is permitted on the basis of signaling data is implemented.

Note that the effects described in this specification are merely examples and not limited thereto, and additional effects may be obtained.

BRIEF DESCRIPTION OF DRAWINGS

FIGS. 24(1) and 24(2) is a diagram illustrating a configuration and a process example of signaling data (USD) according to a delivery path.

MODE FOR CARRYING OUT THE INVENTION

Figure 1:
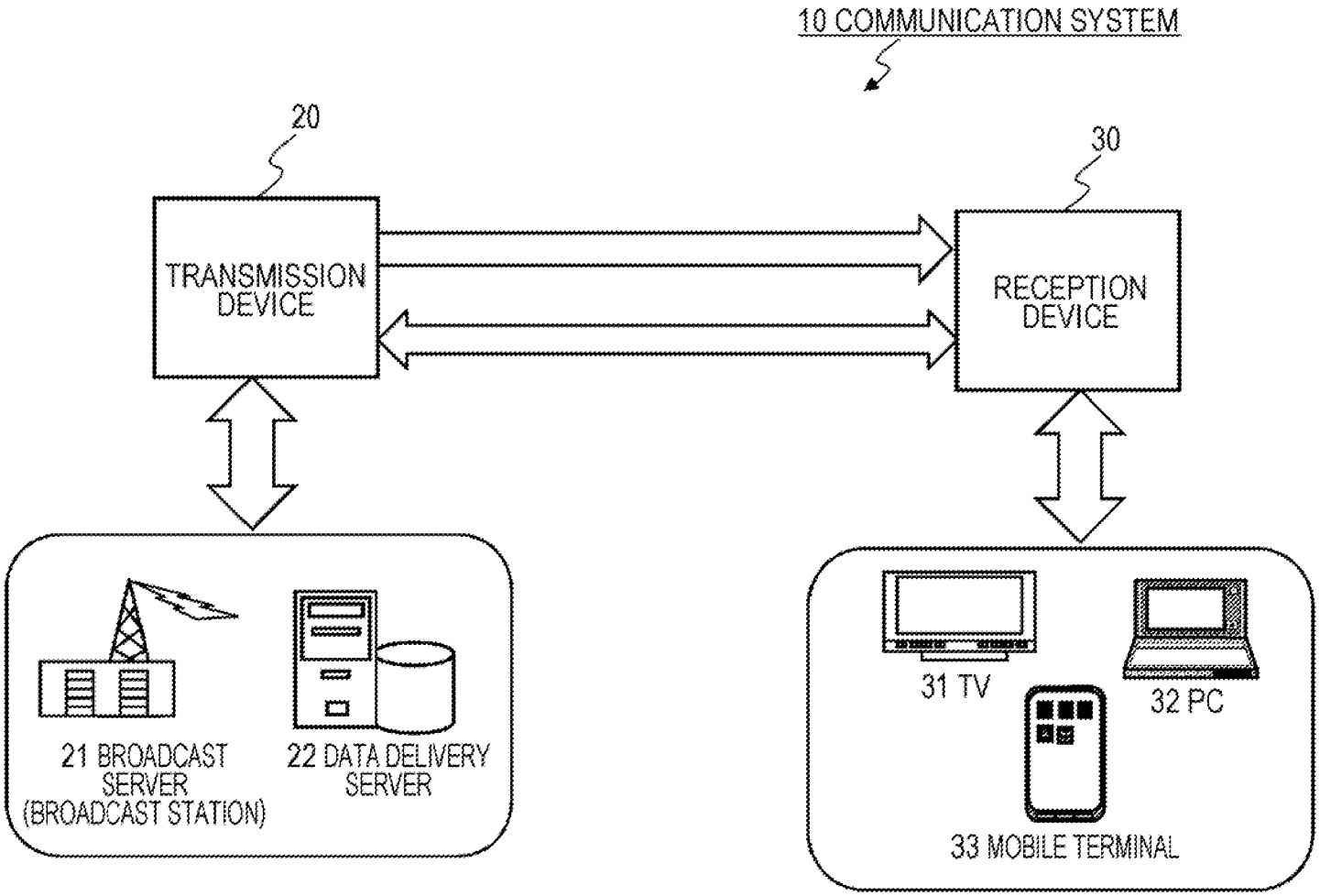
FIG. 1 is a diagram for describing an exemplary configuration of a communication system in which a process of the present disclosure is performed.

A reception device, a transmission device, and a data processing method of the present disclosure will be described below in detail with reference to the appended drawings. Note that a description will proceed according to the following sections.

1. Example configuration of communication system
2. Data communication protocols FLUTE and ROUTE
3. Exemplary communication processes performed by transmission device and reception device
4. Service worker (SW)
5. Example of acquisition and execution of application in reception device
6. File acquisition process sequence in reception device
7. Control process of storage unit (permanent cache) of reception device by service worker (SW)
8. Configuration of notifying of data reception path information using signaling data (USD)
9. Control of redirection policy
9.1. Delivery data acquisition permission example 1 via network
9.2. Delivery data acquisition permission example 2 via network
9.3 Delivery data acquisition permission example 3 via network
10. Example configurations of transmission device and reception device
11. Conclusion of configuration of present disclosure

[1. Example of Configuration of Communication System]

First, an exemplary configuration of a communication system in which a process of the present disclosure is performed will be described with reference to FIG. 1.

A communication system 10 includes a transmission device 20 serving as a communication device that transmits contents such as image data, audio data, or the like and a reception device 30 serving as a communication device that receives the content transmitted from the transmission device 20 as illustrated in FIG. 1.

Specifically, the transmission device 20 is, for example, a device on a content provision side such as a broadcast station 21 and a content server 22.

On the other hand, the reception device 30 is a client device of a general user, and specifically, the reception device 30 includes, for example, a television 31, a PC 32, a mobile terminal 33, or the like.

Data communication between the transmission device 20 and the reception device 30 is performed as communication using at least either or both of two-way communication or one-way communication via a network such as the Internet and one-way communication via a broadcast wave or the like.

Content transmission from the transmission device 20 to the reception device 30 is performed, for example, according to an MPEG-DASH standard which is a standard of an adaptive streaming technique.

The MPEG-DASH standard includes the following two standards:

(a) a standard related to a manifest file (media presentation description (MPD)) for describing metadata serving as management information of moving images or audio files; and (b) a standard related to a file format (a segment format) for moving image content transmission.

Content delivery from the transmission device 20 to the reception device 30 is performed according to the MPEG-DASH standard.

The transmission device 20 encodes content data and generates a data file including encoded data and metadata of the encoded data.

An encoding process is performed, for example, according to an MP4 file format specified in MPEG.

Note that, when the transmission device 20 generates an MP4 format data file, a file of encoded data is referred to as "mdat," and metadata is referred to as "moov," "moof," or the like.

Content provided by the transmission device 20 to the reception device 30 is various data, for example, music data, video data such as movies, television programs, videos, photographs, documents, paintings, and diagrams, games, and software.

Transmission data of the transmission device 20 will be described with reference to FIG. 2.

Figure 2:
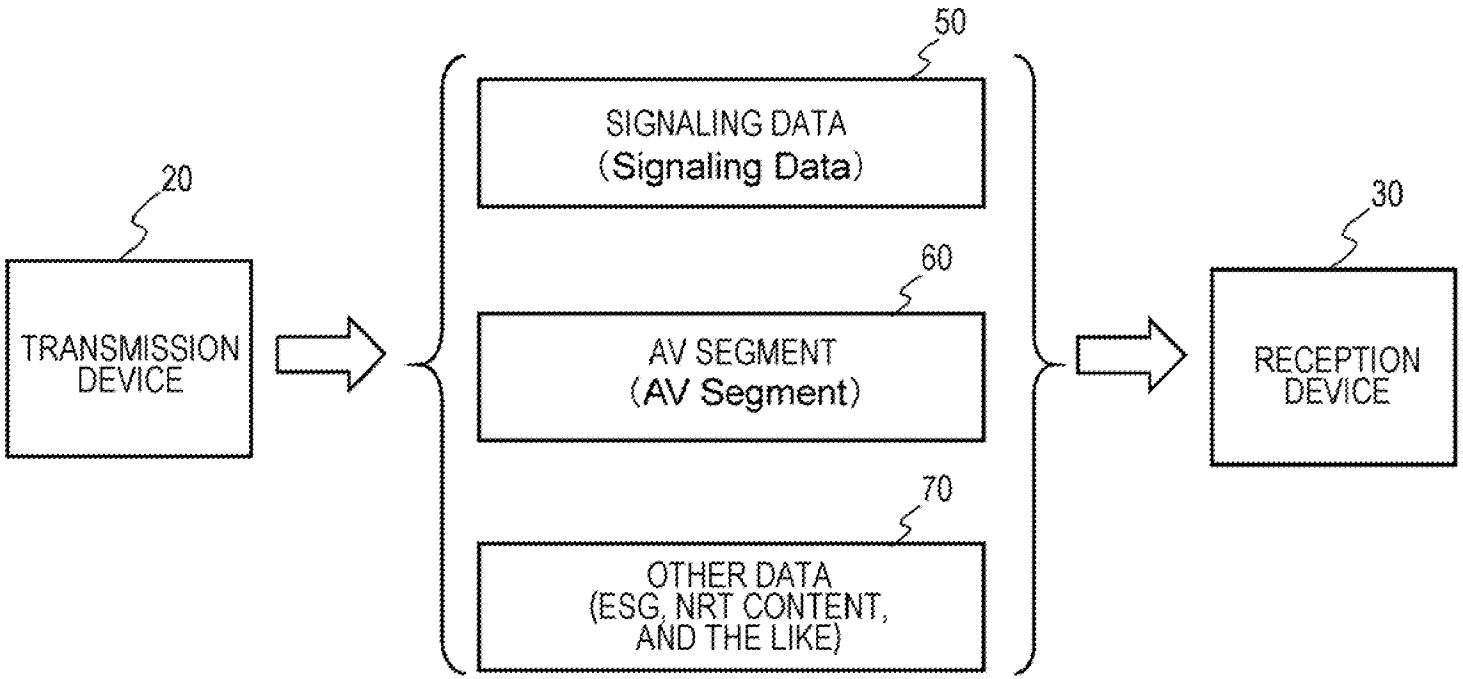
FIG. 2 is a diagram for describing transmission data of a transmission device.

Data transmitted by the transmission device 20 which performs data transmission according to the MPEG-DASH standard are roughly divided into a plurality of kinds of following data as illustrated in FIG. 2:

(a) signaling data 50;

(b) AV segment 60; and (c) other data (ESG, NRT content, or the like) 70.

For example, the AV segment 60 is configured with an image (video) or audio data which is reproduced in the reception device, that is, program content or the like provided from a broadcast station. For example, the AV segment 60 is configured with MP4 encoded data (mdat) and metadata (moov and moof).

On the other hand, the signaling data 50 is configured with program schedule information such as a program table, address information (a uniform resource locator (URL) or the like) necessary for program acquisition, guide information including information necessary for a reproduction process of content such as codec information (an encoding scheme or the like) or the like, and control information.

The reception device 30 has to receive the signaling data 50 before reception of the AV segment 60 storing program content serving as a reproduction target.

For example, the signaling data 50 is transmitted to the reception device (client) which is a user equipment such as a smartphone or a television as data of an extensible markup language (XML) format.

As described above, the signaling data is repeatedly transmitted as necessary.

For example, the signaling data is transmitted frequently and repeatedly at intervals of 100 msec.

This is because the reception device (client) can immediately acquire the signaling data at any time.

The client (reception device) can promptly perform a process necessary for reception and reproduction of program content such as acquisition of an access address of necessary program content, a codec setting process, or the like on the basis of receivable signaling data as necessary.

The other data 70 includes, for example, an electronic service guide (ESG), NRT content, and the like.

The ESG is an electronic service guide, for example, guide information such as a program table.

The NRT content is non-real time type content.

For example, data files such as various application files, moving images, or still images which are executed on a browser of the reception device 30 serving as a client are included in the NRT content.

A service worker used as a control program of an application (which will be described later) or the like is also included in the NRT content.

The following data illustrated in FIG. 2 are transmitted, for example, according to a data communication protocol: a file delivery over uni-directional transport (FLUTE):

(a) the signaling data 50;

(b) the AV segment 60; and (c) the other data (ESG, NRT content, or the like) 70

[2. Data Communication Protocols FLUTE and ROUTE]

The data communication protocol FLUTE is a protocol for performing session management of content to be transmitted in a multicast manner.

For example, a file (which is identified by a URL and a version) generated at a server side serving as a transmission device is transmitted to a client serving as a reception device according to the FLUTE protocol.

The reception device (client) 30 stores a URL and a version of a received file and a file, for example, in a storage unit (client cache) of the reception device (client) 30 in association with each other.

When a URL is identical but aversion is different, it is regarded that content of the file is updated. In the FLUTE protocol, only one-way file transfer control is performed, there is no selective filtering function of a file in a client, but it is possible to implement selective filtering by choosing a file that undergoes transfer control according to FLUTE at a client side using metadata linked with the file and configure, update, and manage a local cache in which the user's preference is reflected.

Note that the metadata may be extended and incorporated into FLUTE protocol or may be described separately by a protocol such as an electronic service guide (ESG).

Note that FLUTE has been standardized originally as a file transfer protocol in multicast.

FLUTE is configured with FDT and a multicast protocol of a scalable file object called ALC, specifically, a combination of LCT or FEC components which are building blocks thereof.

FLUTE of a related art has been mainly developed for use in asynchronous file transfer, and currently, FLUTE is extended to be easily applied even to broadcast live streaming in Advanced Television SystemCommittee (ATSC) which is a standardization organization related to data delivery systems via a broadcast wave and a network.

The extended specification of FLUTE is called real-time object delivery over unidirectional transport (ROUTE).

Advanced Television System Committee (ATSC) 3.0 is currently being standardized as one of standards related to data delivery systems via a broadcast wave and a network. ATSC 3.0 specifies a stack configuration in which instead of the FLUTE protocol of the related art, ROUTE is employed for transmission of signaling data, ESGs, asynchronous files, synchronous streams, and the like.

[3. Exemplary Communication Processes Performed by Transmission Device and Reception Device]

Next, exemplary communication processes performed by the transmission device and the reception device will be described.

Figure 3:
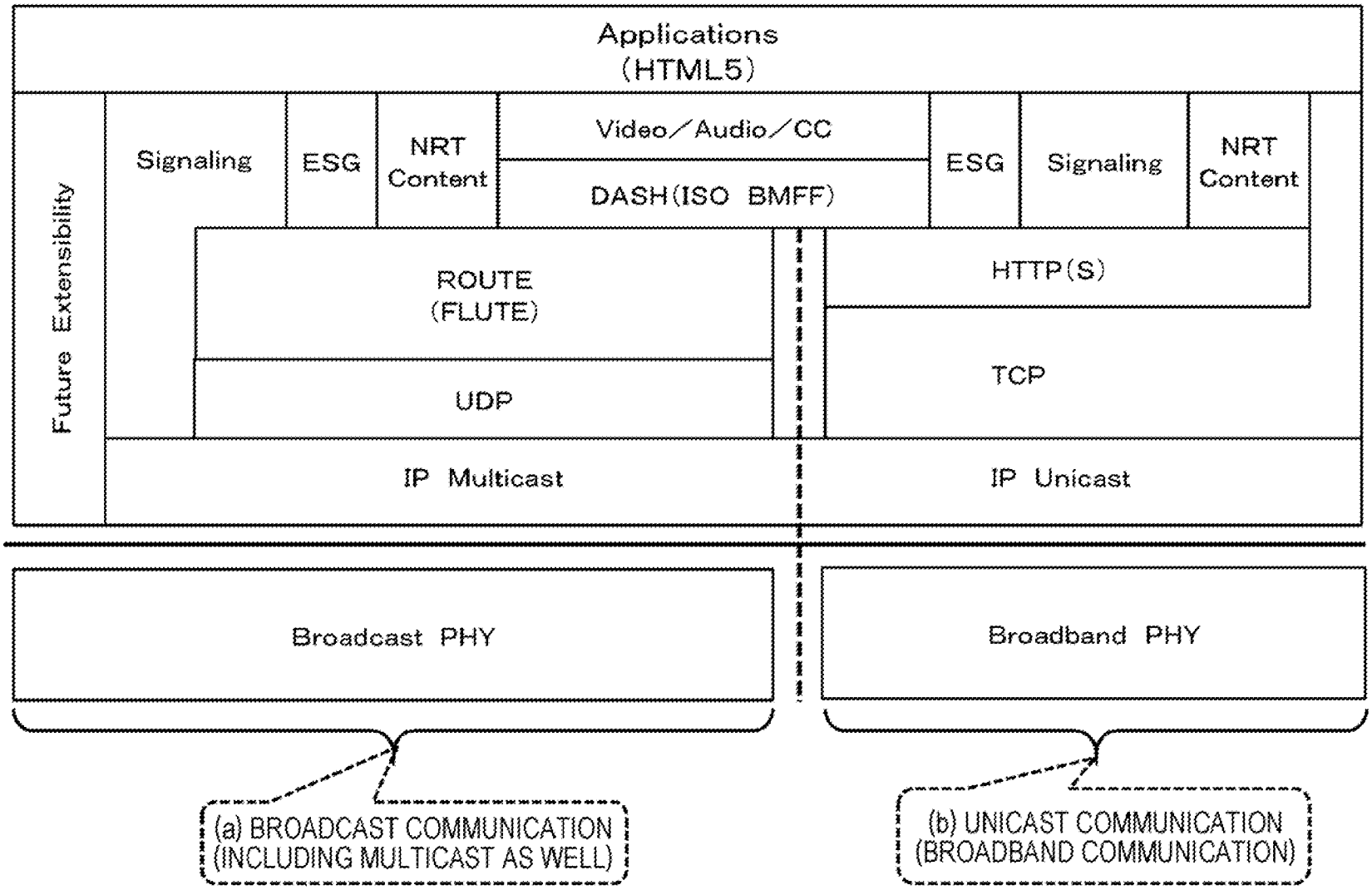
FIG. 3 is a diagram illustrating an example of a protocol stack of a transmission device and a reception device.

FIG. 3 is a diagram illustrating an example of protocol stacks of the transmission device and the reception device.

In the example illustrated in FIG. 3, two protocol stacks for processing the following two pieces of communication data are illustrated:

(a) broadcast (including multicast) communication (for example, broadcast type data delivery); and (b) unicast (broadband) communication (for example, HTTP type P2P communication).

A left side of FIG. 3 is (a) a protocol stack corresponding to broadcast communication (for example, broadcast type data delivery).

A right side of FIG. 3 is (b) a protocol stack corresponding to unicast (broadband) communication (for example, HTTP type P2P communication).

The protocol stack corresponding to (a) the broadcast communication (for example, the broadcast type data delivery) illustrated on the left side of FIG. 3 has the following layers in order from a lower layer:

(1) a broadcast physical layer (Broadcast PHY);

(2) an IP multicast layer (IP Multicast);

(3) a UDP layer;

(4) a ROUTE (=extended FLUTE) layer;

(5) an ESG, NRT content, DASH (ISO BMFF), and Video/Audio/CC; and (6) an application layer (Applications (HTML5)).

Note that a signaling layer is set as a layer above (2) the IP multicast layer (IP Multicast).

The signaling layer is a layer applied to the transmission and reception of the signaling data 50 described above with reference to FIG. 2. The signaling data includes program schedule information such as a program table, address information (a URL or the like) necessary for program acquisition, guide information including information necessary for a reproduction process of content such as codec information (an encoding scheme or the like) or the like, and control information.

Note that a use permission layer of a new protocol in the future (Future Extensibility) is set as a layer above (1) the broadcast physical layer (Broadcast PHY).

(1) The broadcast physical layer (Broadcast PHY) is a physical layer configured with a communication control unit for controlling, for example, a communication unit of a broadcast system for executing broadcast communication.

(2) The IP multicast layer (IP multicast) is a layer in which a data transmission/reception process according to an IP multicast is performed.

(3) The UDP layer is a layer in which a process of generating and analyzing a UDP packet is performed.

(4) The ROUTE layer is a layer in which transfer data is stored and extracted according to the ROUTE protocol serving as the extended FLUTE protocol.

Similarly to FLUTE, ROUTE is a multicast protocol of a scalable file object called ALC, and specifically, ROUTE is configured with a combination of LCT or FEC components which are building blocks thereof.

(5) The ESG, NRT content, DASH (ISO BMFF) and Video/Audio/CC are data transferred according to the ROUTE protocol.

The broadcast type delivery service according to the DASH standard is called a multimedia broadcast multicast service (MBMS). There is an evolved multimedia broadcast multicast service (eMBMS) as a scheme for efficiently implementing MBMS in LTE.

MBMS and eMBMS are broadcast type delivery services, that is, services for simultaneously delivering the same data such as movie content or the like to a plurality of user terminals (UE) which are reception devices located in a specific area through a common bearer. Through broadcast delivery according to MBMS or eMBMS, it is possible to simultaneously provide the same content to reception devices such as a plurality of smartphones, PCs, or televisions located in a delivery service provision area.

In MBMS, and eMBMS, a process of downloading files according to a 3GPP file format (ISO-BMFF files or MP4 files) is specified according to the transfer protocol ROUTE or FLUTE.

Most of the following data described above with reference to FIG. 2 are transmitted according to the ROUTE protocol or the FLUTE protocol:

(a) the signaling data 50;

(b) the AV segment 60; and (c) the other data (ESG, NRT content, or the like) 70

(5) The ESG, NRT content, DASH (ISO BMFF) and Video/Audio/CC are data which is transferred according to the ROUTE protocol.

The ESG is an electronic service guide, for example, guide information such as program table.

The NRT content is non-real time type content.

As described above, for example, data files such as various application files, moving images, or still images which are executed on a browser of the reception device serving as a client are included in the NRT content. Further, a service worker (SW) used as a control program of an application (which will be described later) or the like is also included in the NRT content.

The Video/Audio/CC is actual data serving as a reproduction target such as videos or audios delivered according to the DASH standard.

(6) The application layer (Applications (HTML5)) is an application layer in which generation or analysis of data to be transferred according to ROUTE protocol is performed, and output control of various data is performed, for example, data generation, analysis, an output process, and the like to which HTML5 is applied is performed.

On the other hand, the protocol stack corresponding to (b) the unicast (broadband) communication (for example, HTTP type P2P communication) illustrated on the right side of FIG. 3 has the following layers in order from the lower layer:

(1) a broadband physical layer (Broadband PHY);

(2) an IP unicast layer (IP Unicast);

(3) a TCP layer;

(4) an HTTP layer;

(5) ESG, Signaling, NRT content, DASH (ISO BMFF) and Video/Audio/CC;

(6) an application layer (Applications (HTML5)).

(1) The broadband physical layer (Broadband PHY) is a physical layer configured with a communication control unit such as a device driver for controlling a communication unit such as a network card for executing broadband communication.

(2) The IP unicast layer (IP Unicast) is a layer in which the IP unicast transmission/reception process is performed.

(3) The HTTP layer is an HTTP packet generation/analysis processing layer.

The upper layer is similar to the stack configuration of (a) the broadcast communication (for example, broadcast type data delivery) on the left side of FIG. 3.

Note that the transmission device (server) 20 and the reception device (client) 30 perform a process according to at least one of the two processing systems of FIG. 3, that is, the following two communication protocol stacks:

(a) broadcast communication (for example, broadcast type data delivery);

(b) unicast (broadband) communication (for example, HTTP type P2P communication).

In the protocol stack illustrated in FIG. 3, an attribute of a file group which is multicast and transferred according to ROUTE (FLUTE) (including a URL serving as an identifier of a file) can be described in signaling data in which a file transfer session is described when it can be described in a control file of ROUTE (FLUTE). Further, a more detailed attribute of a file transfer session can be described by an ESG (which can also be used for presentation to end users).

[4. Service Worker (SW)]

Next, the service worker (SW) which is provided by the transmission device (server) 20 and mainly used in the reception device (client) 30 will be described.

The service worker (SW) is provided to the reception device from the transmission device 20 such as a broadcast server 21 or a data delivery server 22.

The service worker (SW) is a program which performs an acquisition process for an application (=an application program) executed in the reception device (client) 30, a data file used when an application is performed, or the like, a storage process in a storage unit (cache), an update process, a deletion process, and the like. Specifically, service worker (SW) is configured with, for example, JavaScript (registered trademark).

For example, the service worker (SW) is set corresponding to the broadcast program (broadcast content) provided by the transmission device 20 such as the broadcast server 21, the data delivery server 22, and the like, and provided to the reception device 30 as a control/management program of an application provided from the transmission device 20 to the reception device 30.

The service worker (SW), the application, and the data file used when the application is executed are provided from the transmission device 20 to the reception device 30, for example, as the NRT content (non-real time content) described above with reference to FIGS. 2 and 3.

Alternatively, a data provision server different from a server that delivers a broadcast program may be configured to provide the service worker (SW), the application, and the data file used when the application is executed to the reception device 30.

For example, the service worker (SW) performs management (acquiring, retention, update, deletion, and the like) of an application or the like for performing information display using a browser which is a program used for performing a browsing process of a web page or the like in the reception device 30.

A specific example (use case) of a process using the service worker (SW) will be described with reference to FIGS. 4 and 5.

Figure 4:
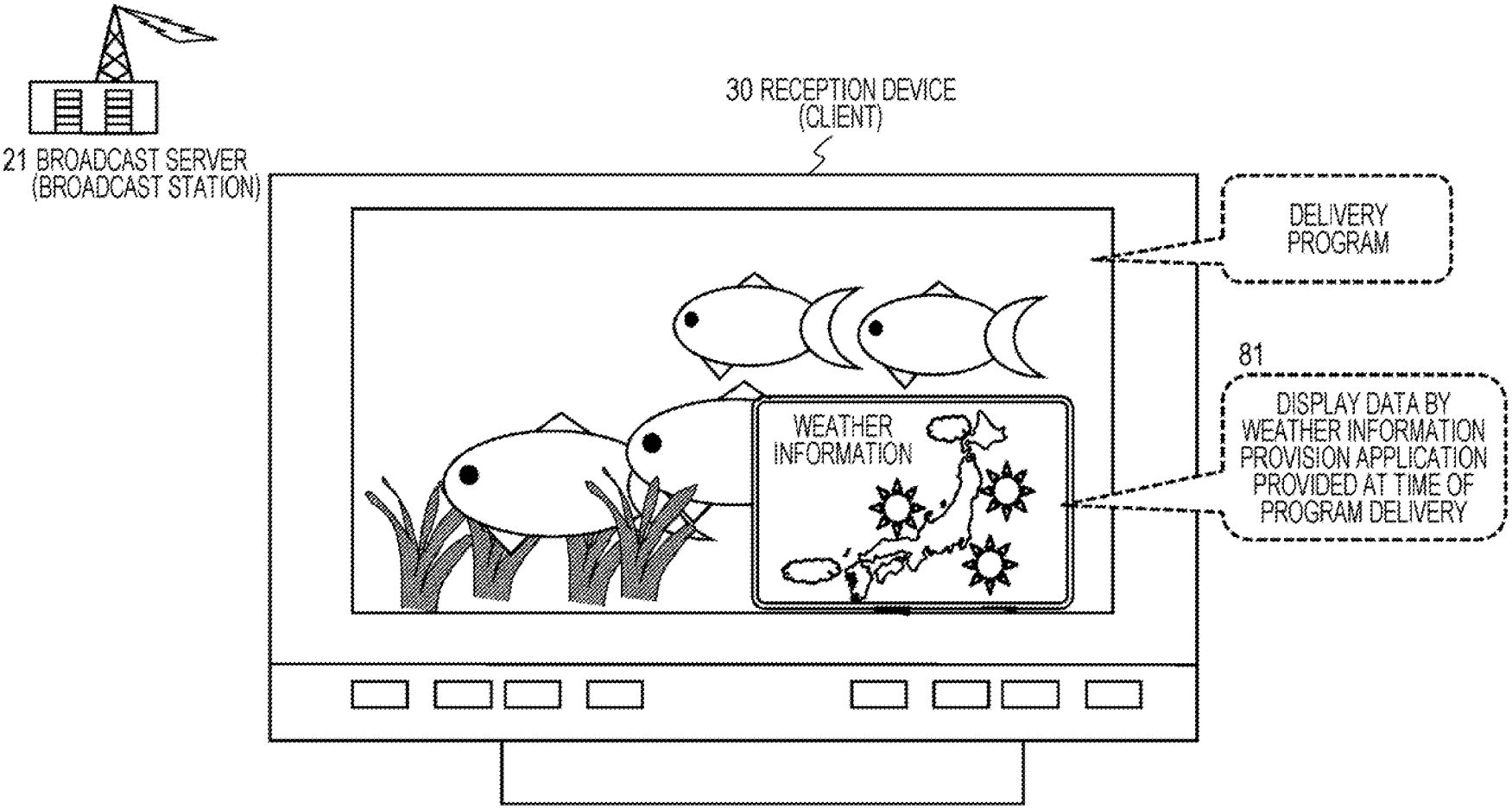
FIG. 4 is a diagram for describing a specific example (use case) of a process using a service worker (SW).

FIG. 4 illustrates a state in which the reception device 30 receives certain program content from the transmission device 20 such as the broadcast server 21 and displays the program content on the display unit of the reception device 30.

In addition to the program delivery, the transmission device 20 such as the broadcast server 21 provides an application for displaying weather information and various data files used for the weather information display application, for example, data files including various data such as moving images, still images, and audios to the reception device 30 as the NRT content (non-real time content).

Hereinafter, the application and the data files are referred to as "resources."

The broadcast server 21 further provides the service worker (SW) serving as a resource management program for managing the "resources" to the reception device 30 as the NRT content (non-real time content).

The reception device 30 can perform display of the weather information together with program display as illustrated in FIG. 4 using the "resource" received from the transmission device 20, that is, the application and the data files.

In the data delivery configuration described above, such data display using the application is disabled at the same time as when the program provided by the application ends.

This is because the resources such as the weather information display application are set to be usable in the reception device 30 during reception of the program, for example, stored in a temporary storage cache and are set in an usable state, but when the program ends or the user switches a channel, such cache data is erased or set in a non-accessible state.

The service worker (SW) functions as a resource management program that enables an application or data corresponding to the program to be usable even after the program ends, even after a channel is switched, or even in an offline state such as a broadcast non-reception state or a network non-connection state.

Figure 5:
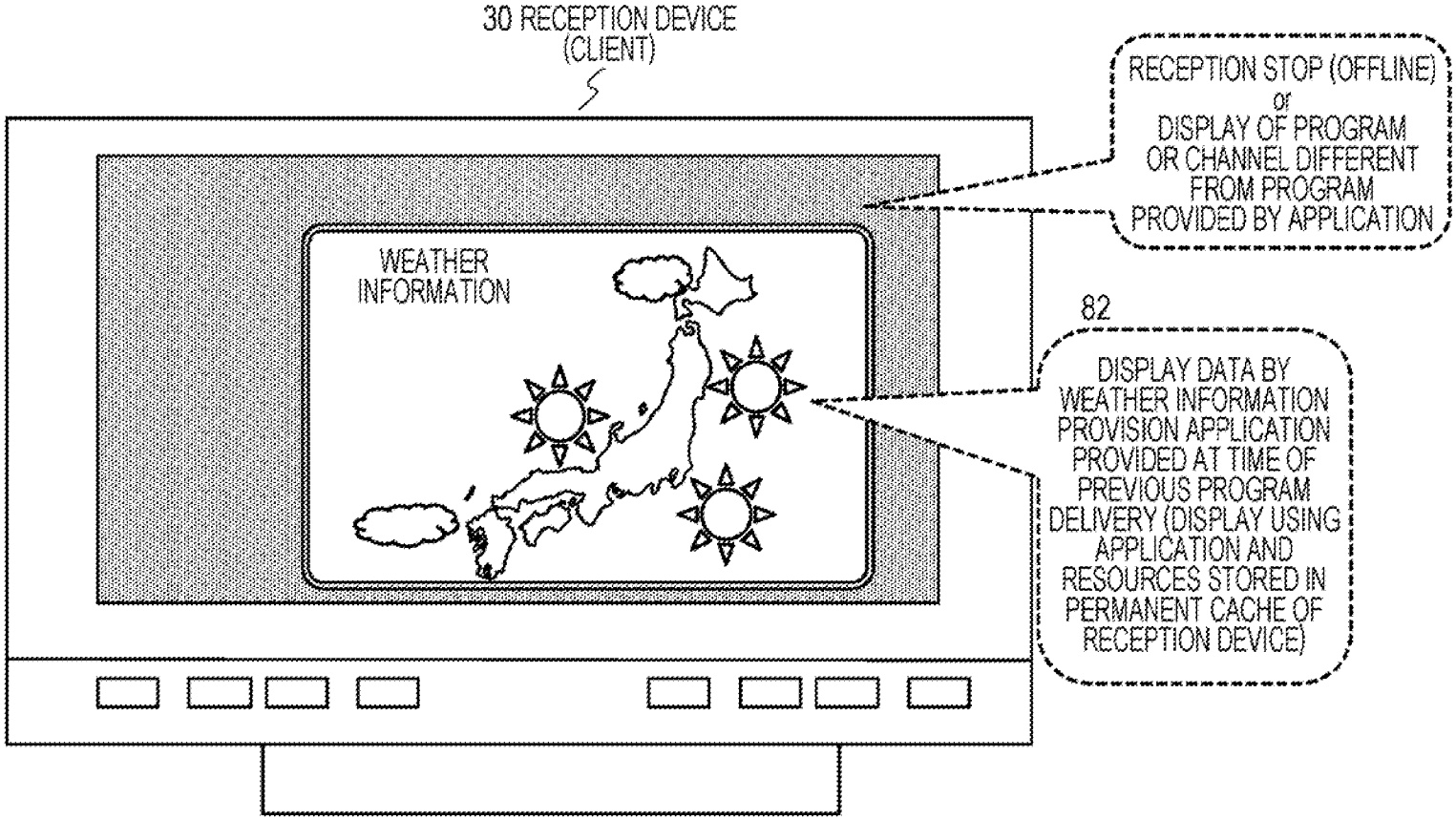
FIG. 5 is a diagram for describing a specific example (use case) of a process using a service worker (SW).

It is possible to enable the weather information display application to be usable even after the program provided by the application ends, even after switching to another channel is performed, or even in an offline state in which data reception is not performed as illustrated in FIG. 5. In other words, it is possible to cause the weather information to be displayed on the display unit of the reception device 30 and browsed.

Note that the weather information display application is, for example, a program displayed on the browser.

The weather information display application is stored in a storage unit (permanent cache) of the reception device 30 under the control of the service worker (SW). For example, when there is a request (event) such as a display request from the user, the weather information display application is read out from the storage unit (permanent cache) and displayed on the display unit under the control of the service worker (SW).

Note that the storage unit (permanent cache) storing the resources such as the application is preferably a nonvolatile memory in which stored data is not erased even when the reception device 30 is powered off.

As described above, using the service worker (SW), it is possible to use various program correspondence applications irrespective of display or non-display of a program.

Note that the service worker (SW) is set, for example, in units of resources corresponding to a certain program (in units of applications and application-related data) and provided from the transmission device 20 to the reception device 30 together with the resources or before or after transmission of the resources.

The service worker (SW) can be set for each program, but it is also possible to set a service worker (SW) which can be used in common to resources corresponding to a specific channel including a plurality of programs.

The service worker (SW) and the resources (the application and application-related data) managed by the service worker (SW) are stored in the storage unit (permanent cache) of the reception device 30.

Figure 6:
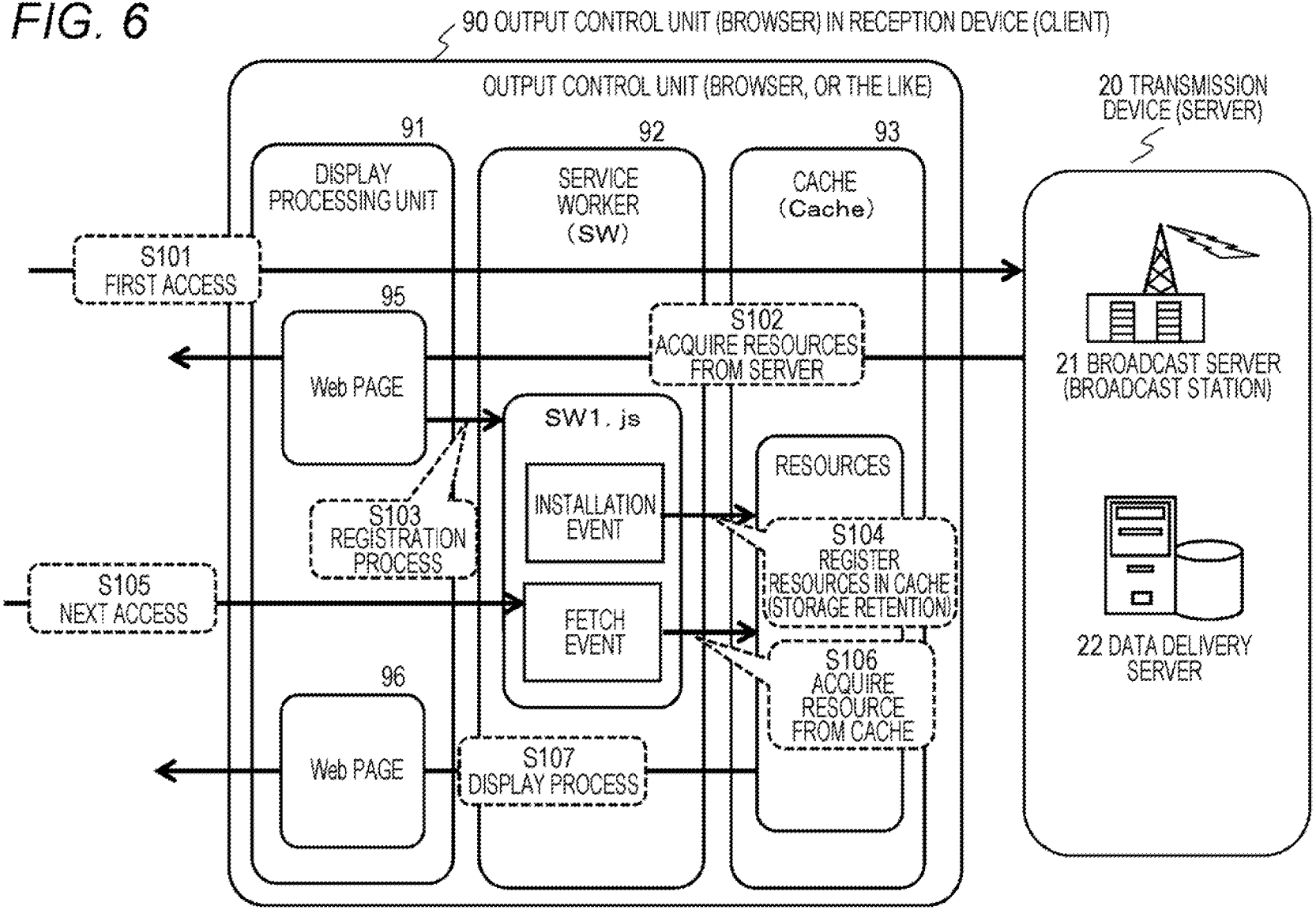
FIG. 6 is a diagram for describing an example of a process using a service worker (SW).

FIG. 6 is a diagram for describing an example of a process using the service worker (SW).

FIG. 6 illustrates an example of a sequence in which the reception device 30 acquires a web page serving as resources (for example, the weather information display page illustrated in FIGS. 4 and 5) from the transmission device 20, stores the web page in the storage unit (permanent cache) of the reception device 30, and uses the web page.

Note that the web page is displayed using a predetermined web page display application and resources configured with display data.

FIG. 6 illustrates a display processing unit 91, a service worker (SW) 92, and a cache (storage unit) 93 as components of an output control unit 90 in the reception device.

Steps S101 to S102 are a resource (web page) acquisition process performed such that the reception device 30 performs a first access processing on the transmission device 20.

For example, it is acquired from the NRT content transmitted from the broadcast server.

After the acquisition process, the display processing unit 91 causes a web page 95 to be displayed on the display unit of the reception device 30.

This display is a state in which the program providing the web page is displayed as well and corresponds to a display state described above with reference to FIG. 3.

In this display period, for example, when there is a resource (web page) registration (installation) request as an instruction by the user, in step S103, the service worker (SW) 92 starts a resource (web page) registration (installation) process.

Specifically, a process of handing the resources over to a cache 93 and storing the resources in the storage unit (permanent cache) is performed as in step S104.

Thereafter, after the program ends, after a channel is switched, or in offline set state, in step S105, the user makes a web page browsing request.

The service worker (SW) 92 detects an input of the browsing request as a fetch event, and in in step S106, the service worker (SW) 92 acquires the resources (web page) from the storage unit (permanent cache) in response to the fetch event detection.

In step S107, the display processing unit 91 displays a web page 96.

The web page display process is a display process after the program ends, after a channel is switched, or in the offline set state and corresponds to the display state described above with reference to FIG. 5.

As described above, using the service worker (SW), it is possible to use various program correspondence applications irrespective of whether or not the program is displayed, and for example, it is possible to perform the process of displaying the web page set as display information of a program attribute at an arbitrary timing irrespective of the program.

As described above, for example, the service worker (SW) performs resource management such as acquisition, storage, update, and deletion of the resources including an application having a web page, an HTML page, JavaScript (registered trademark), and the like as components or data or the like used in an application.

The storage unit (cache) in which the resources are stored is a storage unit (cache) in which stored data is permanently stored, and stores data even when an application does not operate unlike a common local/temporary cache.

A sort of proxy server is implemented in the browser serving as a web page display program, and it is an image that can access the proxy server as necessary at anytime, acquire the web page, and display the web page.

Note that the service worker (SW) is also stored (installed) in the permanent cache. When the service worker (SW) is installed in the reception device, various control can be performed on the resources serving as the management target of this service worker (SW).

For example, in response to an access request to the resources (a fetch request to the resources), before a browser side process (acquisition of resources from a local cache or a network) starts, the process of the service worker (SW) starts, and provision of the resources from the permanent cache is performed.

Further, since service worker (SW) is provided by JavaScirpt (registered trademark), it is possible to incorporate various processes, and it is possible to perform flexible process description for cache control such as update of some resources of the permanent cache.

Note that the service worker (SW) can also be updated. The service worker (SW) is provided from the transmission device 20, but various kinds of information necessary for the update process such as update date/time information and access information of an update date are recorded in header information (HTTP cache-control) of the service worker (SW), and the update process is performed on the basis of the header information.

For example, when an expiration date arrives on the basis of an expiration date or the like set in the header, the reception device 30 performs the acquisition process of a new version of the service worker (SW) and performs the update process of replacing the old version of the SW stored in the cache.

[5. Example of Acquisition and Execution of Application in Reception Device]

As described above, the reception device 30 can execute, for example, an application such as the weather information display application described above with reference to FIGS. 4 and 5, that is, the management target of the service worker (SW) at an arbitrary timing using the service worker (SW).

The user at the reception device 30 side can execute the application at an arbitrary timing and browse a weather information display page or various web pages at any time.

A configuration of the reception device 30 of executing the application will be described with reference to FIG. 7.

Figure 7:
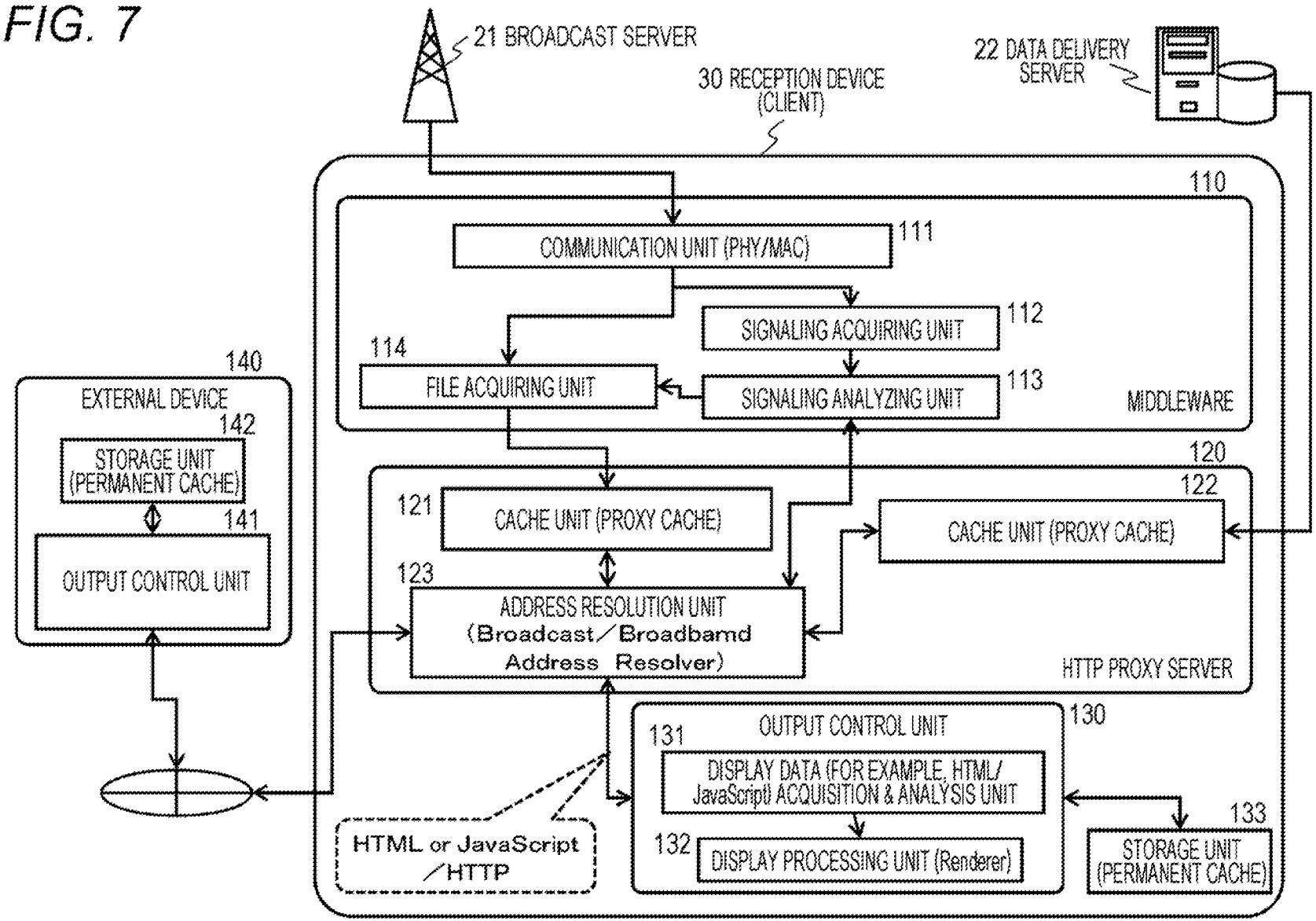
FIG. 7 is a diagram for describing an exemplary configuration of a reception device.

FIG. 7 illustrates an exemplary configuration mainly applied to acquisition and execution of the application as a partial configuration of the reception device 30 for executing a service worker (SW) management application such as the weather information display application.

The reception device 30 includes middleware 110, an HTTP proxy server 120, and an output control unit 130 as illustrated in FIG. 7.

The middleware 110 receives and analyzes provision data of the broadcast server 21.

The middleware 110 includes a communication unit (PHY/MAC) 111, a signaling acquiring unit 112 that acquires signaling data, a signaling analyzing unit 113 that analyzes signaling data, and a file acquiring unit 114 that acquires signaling data and program content data such as videos and voices or data files such as NRT content of an application or the like.

The data received by middleware 110 is stored in a cache unit (proxy cache) 121 of a proxy server 120. The proxy server 120 further stores data acquired from the data delivery server 22 via a network in a cache unit (proxy cache) 122.

The proxy server 120 inputs a data request transferred from the output control unit 130 to an address resolution unit 123, acquires requested data from the cache unit (proxy cache) 121 or 122 or the outside, and provides the requested data.

The output control unit 130 is a data processing unit that executes the service worker (SW) management application such as the weather information display application. For example, the output control unit 130 performs a web page display process or the like on the browser.

The output control unit 130 includes a display data (for example, HTML/JavaScript (registered trademark)) acquisition & analysis unit 131 and a display processing unit (Renderer) 132.

The output control unit 130 acquires and presents middleware (Client Local ATSCMiddleware) 110 in which a broadcast system reception stack is implemented via the proxy server (Client Local HTTP Proxy Server) 120 or acquires and presents an application and a part (HTML page and JavaScript) via a common network stack in which a network system transmission/reception process is performed.

Note that it is also possible to transfer the application and the part (an HTML page or JavaScript) in an output control unit 141 of an external device 150 connected to the reception device 30 via a network such as a LAN and execute the application in the external device 140.

The output control unit 130 can store the service worker (SW) and the resources serving as the management target of the service worker (SW) (the application and the application-related data) in the storage unit (permanent cache) 133 and perform the process using the service worker (SW) and the resources stored in the storage unit (the permanent cache) at an arbitrary timing.

For example, it is possible to output various data using the application at an arbitrary timing as described above with reference to FIGS. 4 and 5. Further, the output control unit 130 performs the update process or the deletion process of the service worker (SW) or the resources (the application and the application-related data) as necessary.

The same applies to the output control unit 141 of the external device 140, and the service worker (SW) or the resources (the application and the application-related data) are stored in a storage unit (permanent cache) 142 of the external device 140, and various data processes using the service worker (SW) or the application are performed at an arbitrary timing. Further, the update process or the deletion process of the service worker (SW) or the resources (the application and the application-related data) is performed as necessary.

Note that, in the model illustrated in FIG. 7, since the output control units 130 and 140 consistently access via the proxy server 120 when access to the outside is performed, it is not distinguished whether the resources such as the application are acquired via broadcasting or a network. In other words, network transparency is provided.

An exemplary data acquisition/provision process according to the data request from the output control unit 130 will be described.

For example, when the output control unit 130 requests acquisition of an HTML page or JavaScript (registered trademark) constituting the application (an HTTP request), the proxy server 120 that has received the request determines whether an HTML page or JavaScript (registered trademark) is acquired via the broadcast reception stack or a network in the address resolution unit (Broadcast/Broadband Address Resolver) 123.

Information serving as a material of the determination is obtained from an analysis result of signaling data by the signaling analyzing unit 113.

The signaling analyzing unit (Signaling Parser) 113 transmits an acquisition request of USBD (USD, SDP, or the like) which is metadata included in the signaling data of ATSC 3.0 to the signaling acquiring unit (Signaling Retriever) 112.

The signaling analyzing unit (Signaling Parser) 113 extracts the metadata included in the signaling data transferred by a signaling data storage LCT packet which is broadcast and received via the communication unit (an ATSC tuner: ATSC 3.0 PHY/MAC) 111.

Further, the signaling analyzing unit (Signaling Parser) 113 resolves broadcast delivery address information for acquiring a requested file from the signaling data (metadata) on the basis of a URL included in the acquisition request of the application component (part). When the application component (part) is determined to be broadcast delivery target data, the file acquiring unit (File Retriever) 114 acquires the file storage LCT packet in which a desired file is stored on the basis of the broadcast delivery address information, and stores the file storage LCT packet in the cache unit (proxy cache) 121.

The proxy server 120 returns the cached file to the output control unit 130 (as an HTTP response). When the URL included in the acquisition request of the application part is not set in the metadata included in the signaling data, the proxy server 120 acquires the file from the data delivery server 22 via a common network stack.

[6. File Acquisition Process Sequence in Reception Device]

Next, a file acquisition process sequence in the reception device will be described.

The reception device (client) 30 performs an acquisition process of acquiring various data files transmitted from the transmission device 20 including the broadcast server 21 or the data delivery server 22.

For example, content segment files which are divisional data files of a broadcast program (content), application files such as data files storing moving images, still images, sounds, or the like which are used when an application is executed, files having the service worker (SW) stored therein, and the like are acquired.

The reception device (client) 30 acquires URLs of various files serving as an acquisition target, for example, according to a process of a broadcast stream reproduction application (which is executed in a browser or a native environment) being executed in the reception device 30.

For example, trigger information for notifying of a URL for activating an application is included in a broadcast stream of a specific program, and a reproduction application can acquire a file URL on the basis of the trigger information.

For example, the reception device 30 extracts a file specified by a URL from a broadcast stream or acquires a file via a network using the URL.

The file acquisition process sequence will be described with reference to sequence diagrams illustrated in FIGS. 8 to 9.

Note that the reception device 30 acquires various files described above such as content segment files, application files, data files storing moving images, still images, sounds, or the like, files having the service worker (SW) stored therein, and the like.

Figure 8:
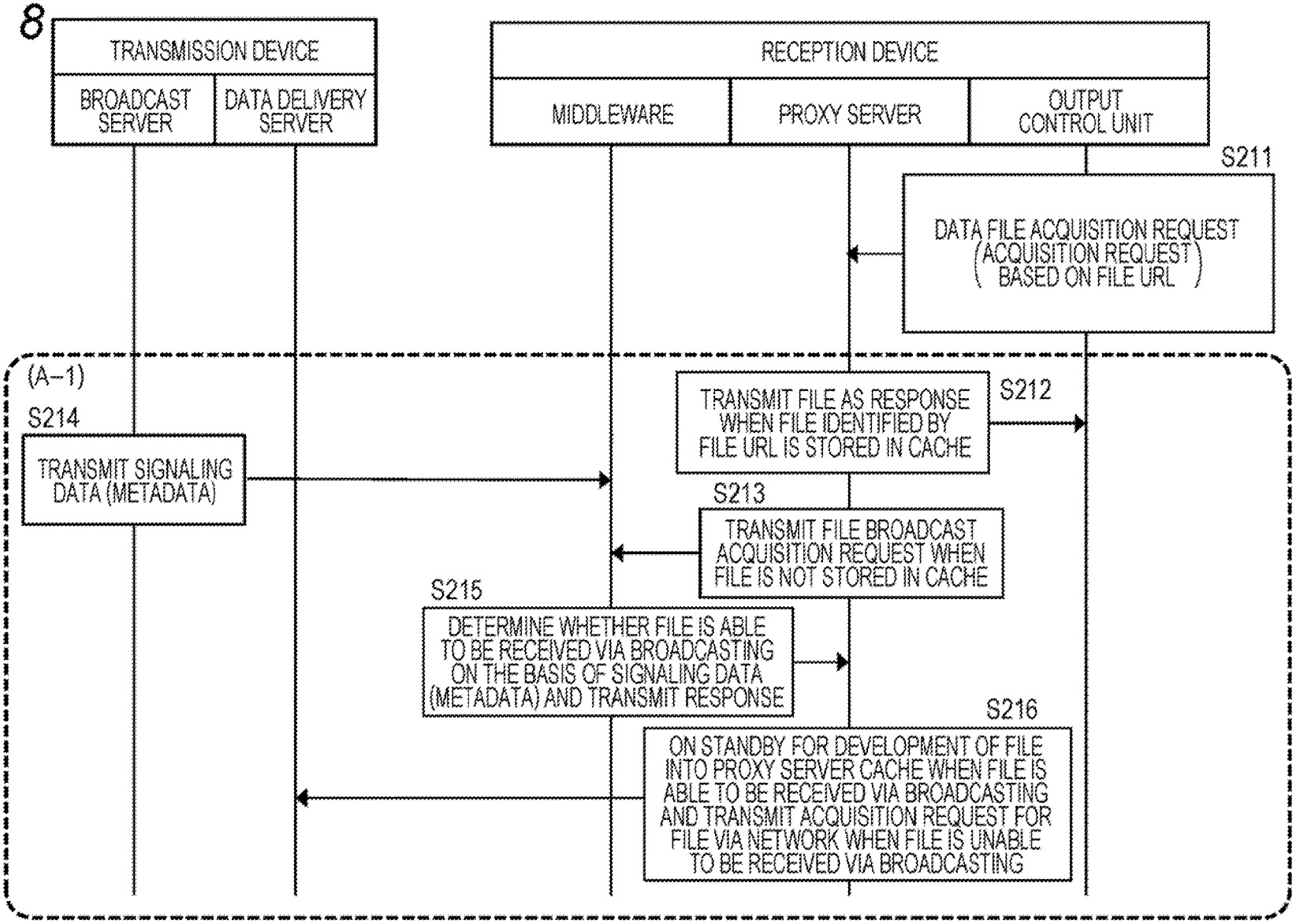
FIG. 8 is a diagram for describing a file acquisition process sequence.
Figure 9:
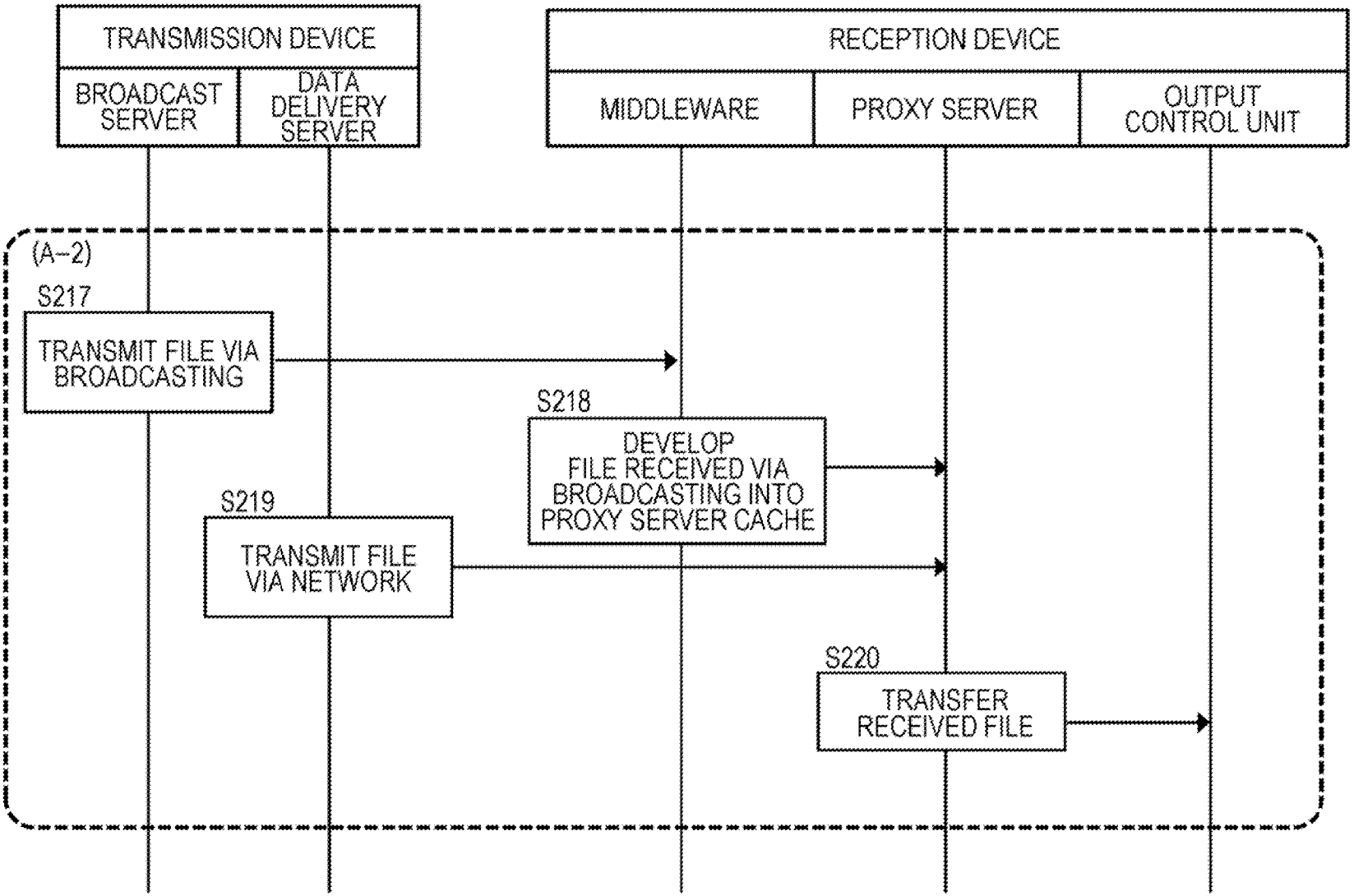
FIG. 9 is a diagram for describing a file acquisition process sequence

In FIGS. 8 and 9, the following components are illustrated from the left.

(a) a broadcast server serving as the transmission device 20;

(b) a data delivery server serving as the transmission device 20;

(c) middleware serving as a component of the reception device 30;

(d) a proxy server serving as a component of the reception device 30; and (e) an output control unit serving as a component of the reception device 30.

Processes of steps illustrated in the sequence diagrams of FIGS. 8 and 9 will be sequentially described.

Note that it is assumed that a native stream reproduction application or a stream reproduction application on the browser is activated in the output control unit of the reception device 30 before process sequences of FIGS. 8 and 9 start.

(Step S211)

First, a native stream reproduction application executed by the output control unit which is a component of the reception device 30 or a stream reproduction application on the browser transmits an acquisition request for a certain data file. For example, a data file acquisition request in which a file URL is designated is transmitted.

Note that, as described above, data transmission from the transmission device 20 to the reception device 30 is performed, for example, according to the MPEG-DASH standard which is a standard of an adaptive streaming technology.

As described above with reference to FIG. 2, data which is transmitted by the transmission device 20 that performs data transmission according to the MPEG-DASH standard is roughly divided into a plurality of kinds of following data:

(a) the signaling data 50;

(b) the AV segment 60; and (c) the other data (ESG, NRT content, or the like) 70.

For example, the AV segment 60 is configured with an image (video) or audio data which is reproduced in the reception device, that is, program content or the like provided from a broadcast station. For example, the AV segment 60 is configured with MP4 encoded data (mdat) and metadata (moov and moof).

The signaling data 50 is configured with program schedule information such as a program table, address information (a URL or the like) necessary for program acquisition, guide information including information necessary for a reproduction process of content such as codec information (an encoding scheme or the like) or the like, and control information.

The other data 70 includes, for example, an electronic service guide (ESG), NRT content, and the like.

The ESG is an electronic service guide, for example, guide information such as a program table.

The NRT content is non-real time type content.

For example, data files such as various application files, moving images, or still images which are executed on a browser of the reception device serving as a client are included in the NRT content. The service worker (SW) is also included in the NRT content.

The (media presentation description (MPD)) is a manifest file describing metadata which is management information of moving images and audio files. Specifically, for example, delivery start time information of program content delivered from the broadcast station, access information for an AV segment, and the like are recorded.

In step S211, for example, the output control unit of the reception device 30 acquires a segment URL which is access information of a content storage segment described in the MPD which is a control file of the DASH streaming of a broadcast content stream, and transmits an acquisition request for a content segment file to the proxy server using the acquired segment URL.

For other application files, data files, service worker (SW) files, or the like, a URL serving as access information is acquired from signaling data or the like, and file access in which the URL is applied is performed.

(Steps S212 to S213)

Next, in step S212, when the file identified by the file URL is stored in the cache managed by the proxy server, the proxy server of the reception device 30 acquires the file from the cache and transmits the acquired file to the control unit as a response.

On the other hand, in step S213, when the file identified by the file URL is determined not to be stored in the cache managed by the proxy server, the proxy server of the reception device 30 outputs the acquisition request for the file to the middleware.

(Step S214)

A process of step S214 indicates a process that is continuously performed by the broadcast server 21. The broadcast server 21 continuously provides signaling data (metadata or the like) including control information, management information, or the like which is related to delivery content to the reception device 30 along with the delivery of the program content.

(Step S215)

A process of step S215 is performed by the middleware when the request for the file is output from the proxy server in step S213.

The middleware determines whether or not the file for which the acquisition request is output from the proxy server is able to be received via broadcasting on the basis of the signaling data (metadata) received from the broadcast server 21, and gives a notification indicating determination information to the proxy server.

(Step S216)

When a notification indicating that the file can be received via broadcasting is received from the middleware, the proxy server is on standby for development (storage) of the file to a management cache of the proxy server.

On the other hand, when a notification indicating that the file is unable to be received via broadcasting is received from the middleware, the proxy server transmits an acquisition request for acquiring the file via a network to the data delivery server 22.

(Steps S217 to S218)

A process of steps S217 to S218 is a process performed when the file for which the acquisition request is output from the proxy server can be received via broadcasting.

In this case, in step S217, the broadcast server 21 transmits the file via a broadcast wave.

In step S218, the middleware of the reception device 30 receives the file transmitted from the broadcast server 21 and develops (stores) the file into the management cache of the proxy server.

(Step S219)

A process of step S219 is a process performed when the file for which the acquisition request is output from the proxy server is unable to be received via broadcasting.

In this case, in step S219, the data delivery server 22 transmits the requested from the reception device 30 to the reception device 30.

The proxy server of the reception device 30 receives the transmitted file and develops (stores) the file into the management cache of the proxy server.

(Step S220)

In step S220, the file which is acquired from the broadcast server 21 or the data delivery server 22 and stored in the proxy server management cache is provided from the proxy server to the output control unit.

[7. Control Process of Storage Unit (Permanent Cache) of Reception Device by Service Worker (SW)]

Next, a control process of the storage unit (permanent cache) of the reception device by the service worker (SW) stored in the reception device 30 according to the file acquisition process or the like will be described.

The service worker (SW) stored in the reception device 30 controls the storage unit (permanent cache), that is, the cache in which the resources are stored using the resources of the management target, that is, the application or the application-related data as one of management processes.

First, the service worker (SW) stores a file necessary for the application that has initially activated the service worker (SW) according to detection of a predetermined event in the storage unit (permanent cache) of the reception device 30.

A timing at which an event serving as a trigger of resource storage by the service worker (SW) is received is a timing at which the registration process or the re-registration (update) process for the service worker (SW) is performed. At this point, the service worker (SW) receives a registration (installation) event.

In addition, an event serving as a trigger of the resource storage process is received at a timing at which the application requests an HTML page or JavaScript (registered trademark) (when a fetch event is received) or when it is reactivated by a timer generated by the service worker (SW).

The application (part group) developed into the storage unit (permanent cache) by the service worker (SW) can be activated as an application (offline application) which is not only activated in association with (at the same time as) the broadcast stream but also installed in a client independently of the broadcast stream.

A control process sequence of the storage unit (permanent cache) of the reception device by the service worker (SW) will be described with reference to sequence diagrams illustrated in FIGS. 10 to 11.

Figure 10:
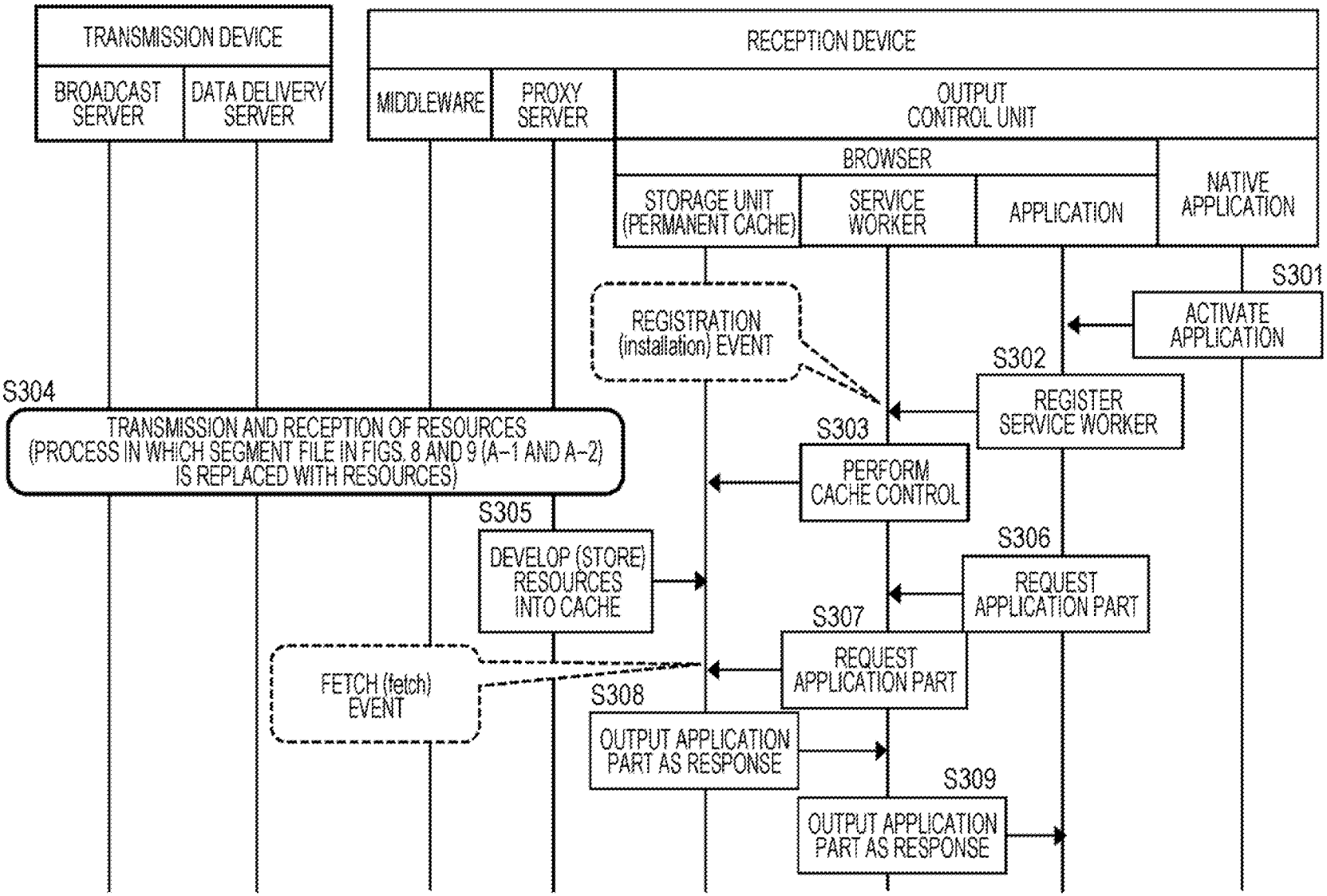
FIG. 10 is a diagram for describing a control process sequence of a storage unit (permanent cache) of a reception device by a service worker (SW).
Figure 11:
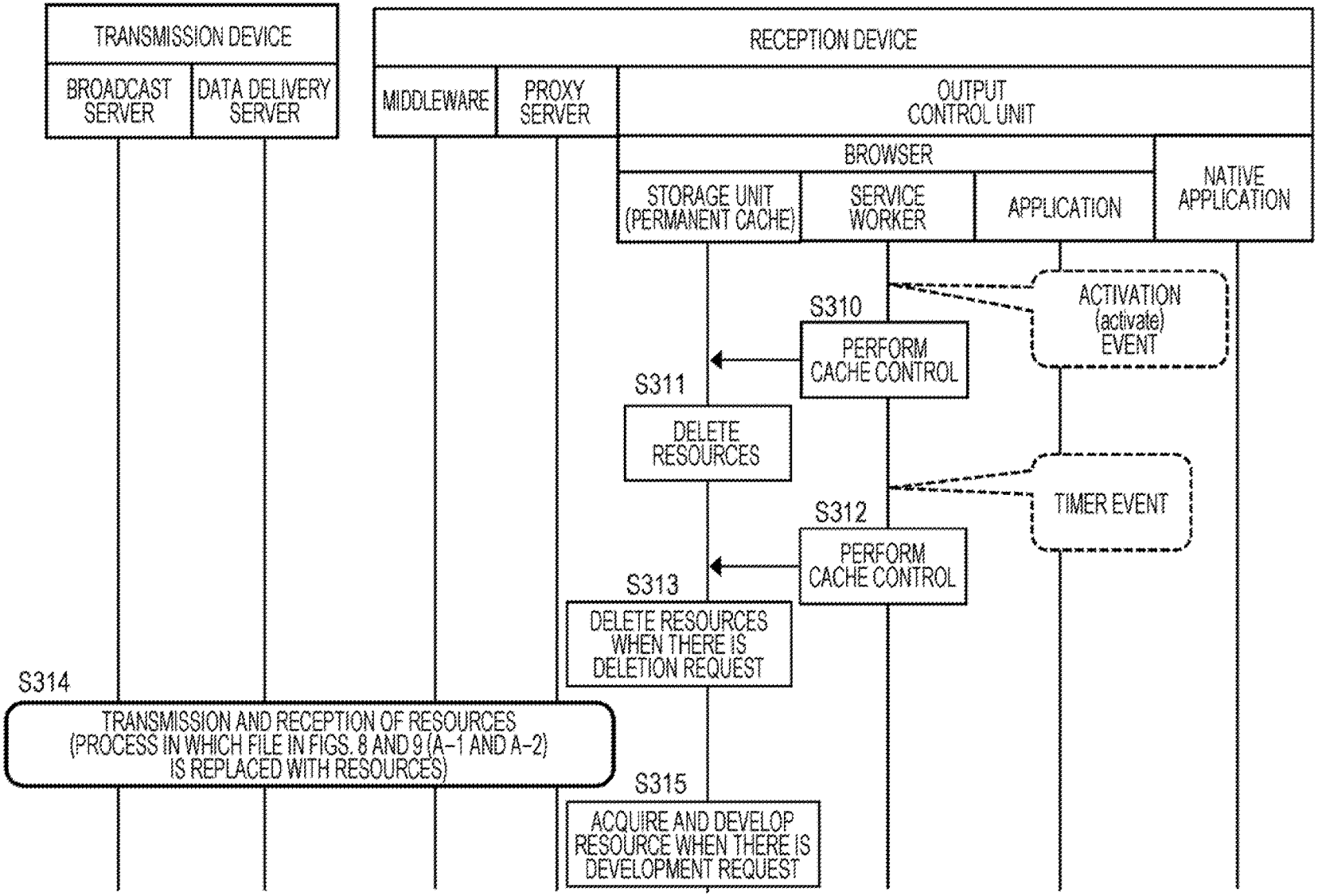
FIG. 11 is a diagram for describing a control process sequence of a storage unit (permanent cache) of a reception device by a service worker (SW).

In FIGS. 10 to 11, the following components are illustrated from the left:

(a) the broadcast server constituting the transmission device;

(b) the data delivery server constituting the transmission device;

(c) the middleware of the reception device;

(d) the proxy server of the reception device;

(e) the storage unit (permanent cache) managed by the browser executed by the output control unit of the reception device;

(f) the service worker (SW) executed on the browser executed by the output control unit of the reception device;

(g) the application executed on the browser executed by the output control unit of the reception device; and (h) the native application executed by the output control unit of the reception device.

Note that the native application is an application executed by the reception device 30, but the native application is not an application managed by the service worker (SW) but, for example, an application used for an activating process of an application corresponding to content (program).

A process of steps illustrated in the sequence diagrams of FIGS. 10 to 11 will be sequentially described.

(Step S301)

A process of step S301 is a process of activating an application corresponding to content (program) through the native application.

As described above, the native application is an application used for the activation process of an application corresponding to content (program).

In the case of a setting in which the application corresponding to content (program) is activated on the basis of, for example, trigger information embedded in a program, the activation process by the native application is unnecessary.

(Step S302)

In step S302, the activated application performs the registration process for the service worker (SW).

Through the registration process, the service worker (SW) is stored in the storage unit (permanent cache) and enters a state in which it can be used at any time.

The service worker (SW) detects the service worker (SW) registration process on the basis of detection of the registration (installation) event, and the service worker (SW) starts the cache control of step S303 using the detection of the registration (installation) event as a trigger.

(Steps S303 to S305)

When the registration (installation) event is detected, in step S303, the service worker (SW) starts control of the storage unit (permanent cache), for example, according to the script description.

Specifically, the acquisition process and the cache development (storage) process for the resources (the application and the application-related data) serving as the management target of the service worker (SW) start.

Note that, in step S304, the resources (the application and the application-related data) serving as the management target of the service worker (SW) are continuously transmitted from the transmission device such as the broadcast server, the data delivery server, or the like.

Note that, in step S304, a process of replacing the process for the segment file in steps of FIGS. 8 to 9 (A-1 to A-2) in the resource transmission/reception process described above with reference to FIGS. 8 to 9 with a process for the resources is performed.

In step S305, transmission data is developed (stored) into the storage unit (permanent cache) through the management cache of the proxy server.

(Steps S306 to S309)

In step S306, the application requests the service worker (SW) to transmit the application part, for example, a moving image file or a still image file necessary for execution of the application, or the application-related data such as a JavaScript (registered trademark) program or audio data.

This request process corresponds to fetch event detection in the service worker (SW).

In steps S307 to S309, the service worker (SW) acquires the requested part from the storage unit (permanent cache) and provides the requested part to the application.

(Steps S310 to S311)

A process of steps S310 to S311 is a process when an activation event is detected by the service worker (SW).

The activation event is detected, for example, when a resource deletion request is input by the user or when an expiration date of the application expires.

When the service worker (SW) detects the activation event, for example, the control of the storage unit (permanent cache) according to the script description starts.

Specifically, for example, the deletion process for the resources (the application and the application-related data) serving as the management target of the service worker (SW) is performed.

(Steps S312 to S315)

A process of steps S312 to S315 is a process when a timer event is detected by the service worker (SW).

The timer event is detected, for example, when the expiration date of the application expires, when an update deadline arrives, or the like.

Examples of the process according to the timer event include deletion of cache resources and an acquisition process of update resources or addition resources.

Step S313 is a sequence of the deletion process of the cache resources corresponding to the timer event.

Steps S314 to S315 illustrate a sequence of the acquisition process of the update resources or the addition resources corresponding to the timer event.

Note that, in step S314, a process of replacing the process for the segment file in steps of FIGS. 8 to 9 (A-1 to A-2) in the resource transmission/reception process described above with reference to FIGS. 8 to 9 with a process for the resources is performed.

[8. Configuration of Notifying of Data Reception Path Information Using Signaling Data (USD)]

Next, a configuration for notifying of data reception path information using signaling data (USD) will be described.

The middleware 110 of the reception device 30 illustrated in FIG. 7 determines whether or not a target file can be received via broadcasting on the basis of the signaling data transmitted from the transmission device 20, transmits information indicating whether or not target file can be received via broadcasting to the address resolution unit (broadcast/broadband address resolver) 123 of the HTTP proxy server 120, and determines whether acquisition is cache acquisition via broadcasting or cache acquisition via a network.

The user service description (USD: UserServiceDescription) is used as the signaling data in which information which the determination is performed on the basis of is stored.

Figure 12:
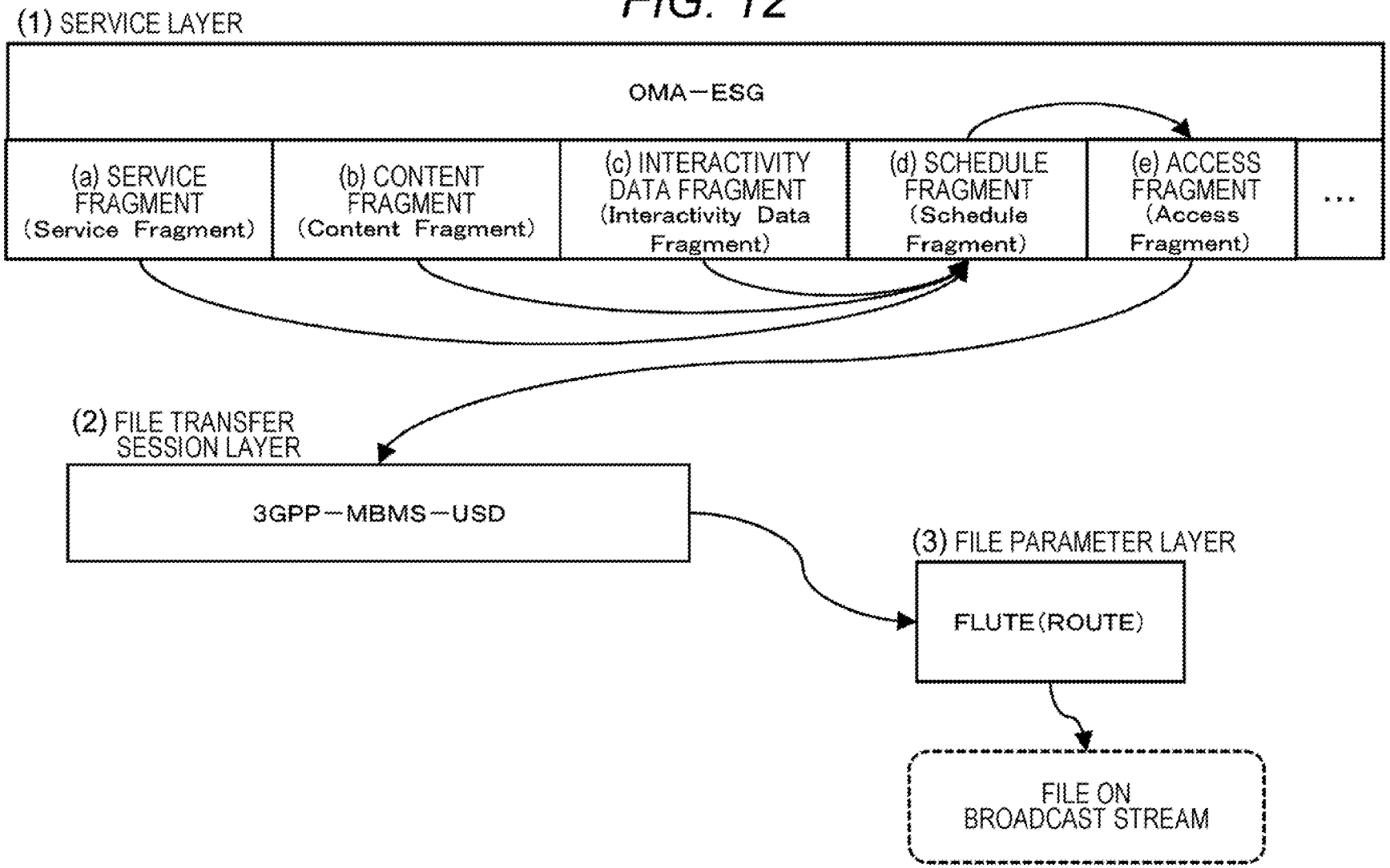
FIG. 12 is a diagram illustrating an exemplary configuration of signaling data (metadata) transmitted from a transmission device.

FIG. 12 is a diagram illustrating an exemplary configuration of the signaling data (metadata) transmitted from the transmission device 20 such as the broadcast server 21.

The signaling data (metadata) has the following three layers as illustrated in FIG. 12:

(1) a service layer (open mobile alliance-electronic service guide (OMA-ESG));

(2) a file transfer session layer (3GPP-MBMS-USD); and (3) a FLUTE (ROUTE) parameter layer (FLUTE (ROUTE)).

(1) The service layer is a layer in which attribute information of service or content which is particularly intended to be presented to the user is described.

(2) The file transfer session layer is a layer in which the transfer parameter of the file or the like is described.

(3) The FLUTE (ROUTE) parameter layer is a layer in which the parameter corresponding to the FLUTE (ROUTE) protocol is described.

Note that arrows illustrated in FIG. 12 illustrate a reference relation between the attribute information (element) recording regions (fragments).

For example, an arrow extending from (a) the service fragment to (d) the schedule fragment indicates that (a) the delivery schedule information corresponding to the services (for example, the channel and the program) recorded in (a) the service fragment is recorded in (d) the schedule fragment.

Each fragment (element) is classified as a region in which a different type of attribute information is recorded.

The signaling data (metadata) of the service unit set in units of programs or channels is recorded in (1) the service layer (OMA-ESG) of the highest level.

(2) The file transfer session layer (3GPP-MBMS-USD) is set below (1) the service layer (OMA-ESG). The user service description (USD) is included in the signaling data (metadata).

Note that the USD stores, for example, information related to a delivery method and includes, for example, the following signaling data:

session description (SDP);

file delivery description (FDD);

repair flow description (RFD); and schedule description (SD).

Further, the USD includes the media presentation description (MPD) as signaling data having a manifest file in which various guide information and control information corresponding to content (AV segment) are stored.

(3) The FLUTE (ROUTE) parameter layer is set below the USD metadata. Specific delivery data information to be delivered according to the FLUTE (ROUTE) protocol, for example, ROUTE metadata in which, for example, transfer parameters of individual files which are actually delivered are recorded is set in this layer.

An example of recording file transmission path information in (2) the file transfer session layer (3GPP-MBMS-USD) will be described below.

The user service description (USD) is a hub-like element in which an attribute of a transport session constituting a service is stored. Further, an element has the same meaning as a fragment.

Figure 13:
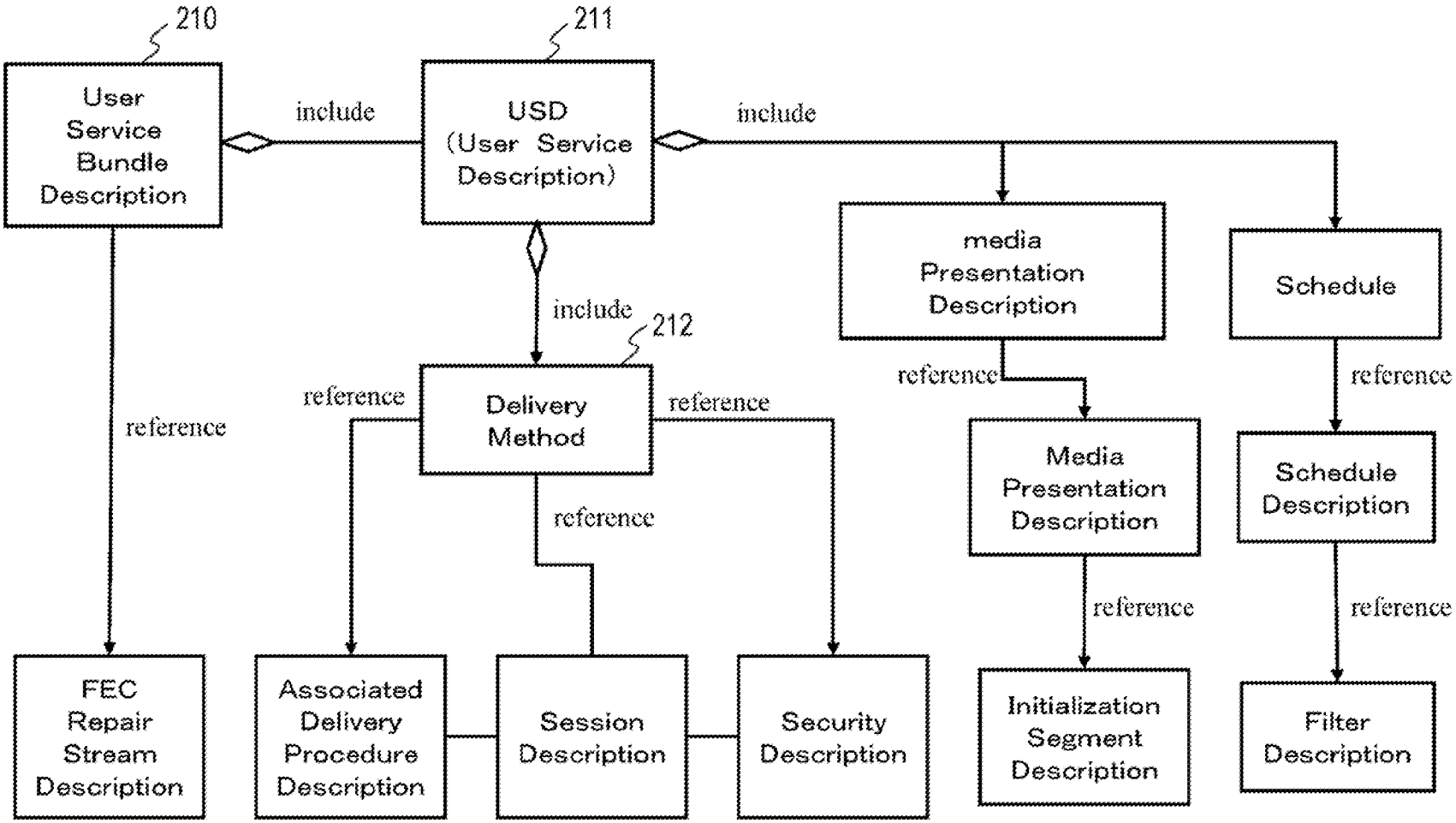
FIG. 13 is a diagram for describing an entire exemplary configuration of a user service description (USD).

FIG. 13 illustrates the entire exemplary configuration of user service description (USD).

A user service bundle description (USD) 210 is a set of a plurality of user service descriptions (USD) 211.

A hollow diamond-shaped arrow illustrated in FIG. 13 indicates that an element at the hollow arrow side includes a connection element.

Normal arrows indicate a reference relation.

A delivery method (deliveryMethod) element 212 is set below the user service description (USD) 211.

Information related to a delivery process for each file is recorded in the delivery method (deliveryMethod) element 212.

In an embodiment of the present disclosure, transmission path information indicating whether each file is transmitted via broadcasting or a network is recorded in the delivery method (deliveryMethod) element 212 which is a subordinate element of the user service description (USD) 211.

Figure 14:
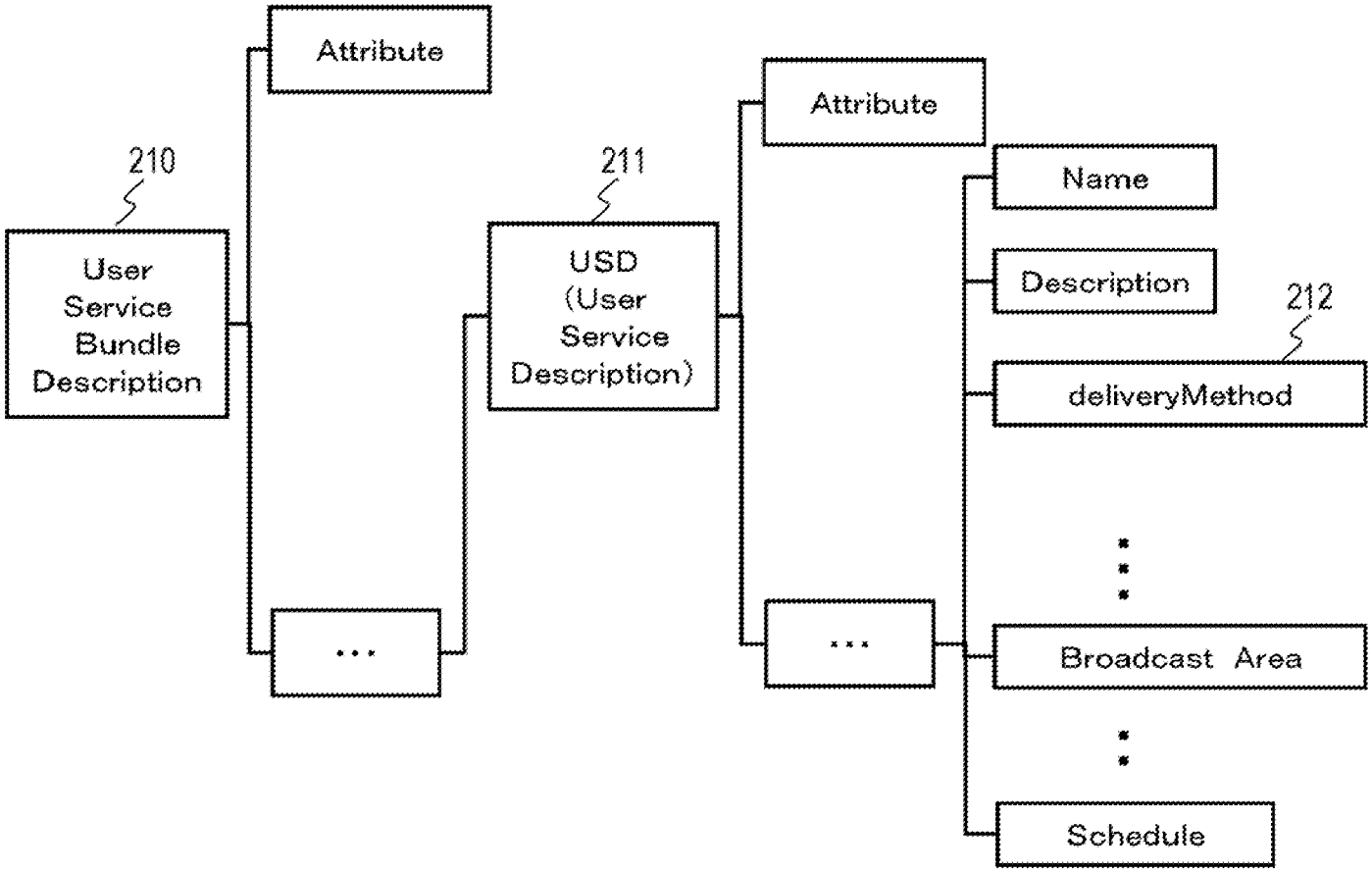
FIG. 14 is a diagram illustrating an exemplary hierarchical configuration below a user service bundle description (USD) constituting signaling data.

FIG. 14 illustrates an exemplary hierarchical configuration below the user service bundle description (USD) 210 constituting the signaling data.

The following elements are set below the user service bundle description (USD) 210:

the user service description (USD) element 211; and the delivery method (deliveryMethod) element 212.

Figure 15:
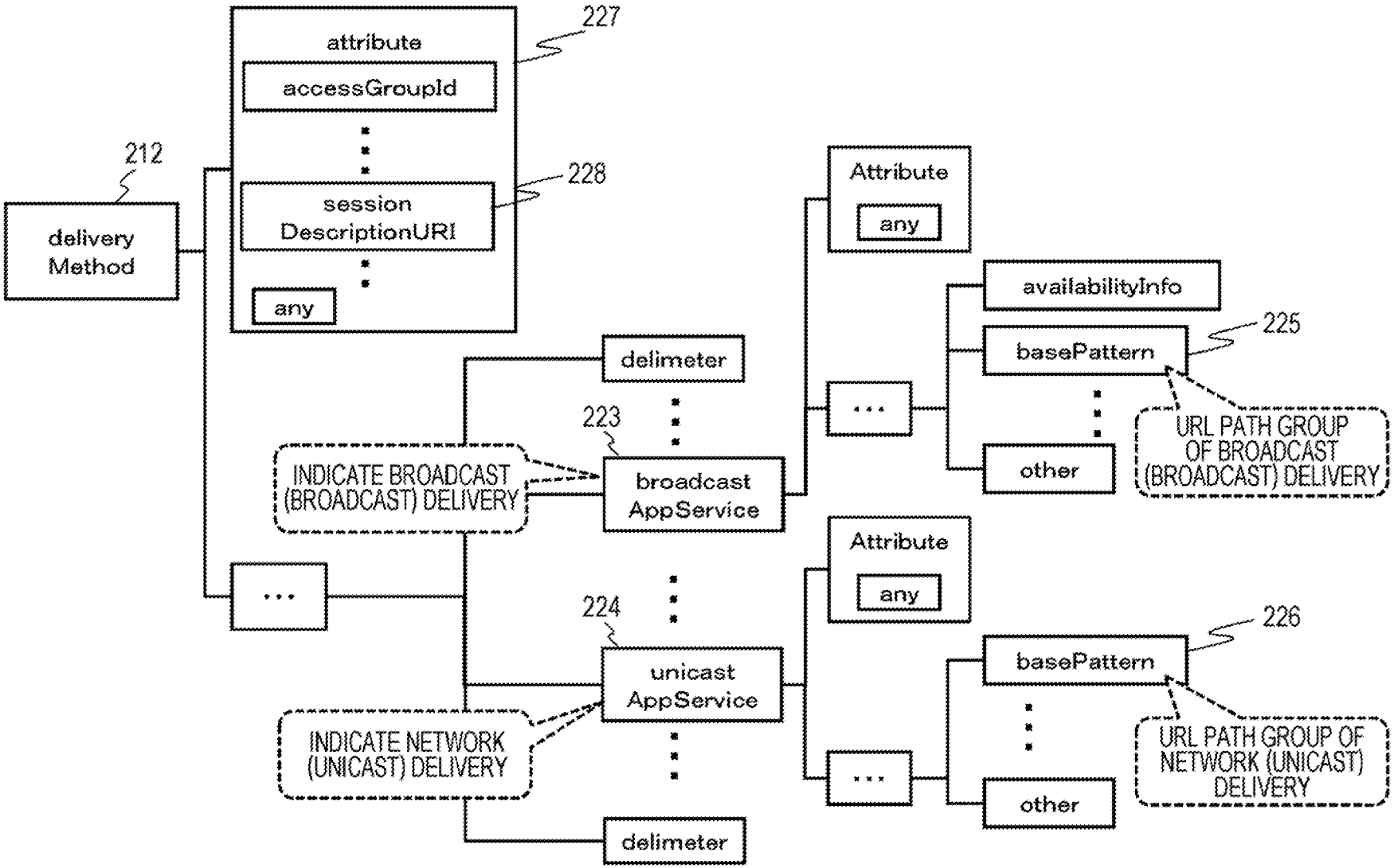
FIG. 15 is a diagram illustrating a signaling data configuration below a delivery method (deliveryMethod) element.

FIG. 15 is a diagram illustrating a signaling data configuration below the delivery method (deliveryMethod) element 212.

Note that the delivery method is set in units of transmission content or transmission data.

For example, a delivery process method set in units of applications, units of service workers (SWs), units of moving images, units of still images, or the like is specified in the signaling data (metadata).

Anyone of the following elements is set below the delivery method (deliveryMethod) element 212 as illustrated in FIG. 15:

(a) a broadcast application service (broadcastAppservice) element 223; and (b) a unicast application service (unicastAppservice) element 224.

When (a) the broadcast application service (broadcastAppservice) element 223 is set, and the base pattern of the file URL is recorded in base pattern (basePattern) information 225 therebelow, it indicates that a file to be delivered by the delivery method (deliveryMethod) is delivered via broadcasting, for example, delivered via a broadcast wave.

On the other hand, when (b) the unicast application service (unicastAppservice) element 224 is set, and the base pattern of the file URL is recorded in base pattern (basePattern) information 226 therebelow, it indicates that the file to be delivered by the delivery method (deliveryMethod) is delivered via unicasting (broadband-delivered), for example, via a network.

When (a) the broadcast application service (broadcastAppservice) element 223 is set, the base pattern (basePattern) information 225 is recorded therebelow.

The base pattern (basePattern) information 225 is data indicating a URL path group corresponding to a file to be delivered via broadcasting.

The reception device acquires a target file from the broadcast wave using the URL information.

On the other hand, when (b) the unicast application service (unicastAppservice) element 224 is set, the base pattern (basePattern) information 226 is recorded therebelow.

The base pattern (basePattern) information 226 is data indicating a URL path group corresponding to a file to be delivered via unicasting.

The reception device acquires a target file via the network using the URL information.

For example, a path portion of a first URL of a file URL is indicated in the base pattern (basePattern) information 225 and 226. Specifically, it is, for example, http://a.com/bc, http://a.com/bb, or the like are indicated. It is indicated that a file having a file URL starting from the path is delivered through a path (broadcasting or a network) indicated by an element thereabove.

For example, http://a.com/bc/x.js indicates that a file is delivered via broadcasting, http://a.com/bb/y.js indicates that a file is delivered via a network.

Further, attribute data 227 is set below the delivery method (deliveryMethod) element 212, and a session description URI (sessionDescriptionURI) element 228 is set in attribute data 222 as illustrated in FIG. 15.

Here, reference information to FLUTE (ROUTE) is stored.

Figure 16:
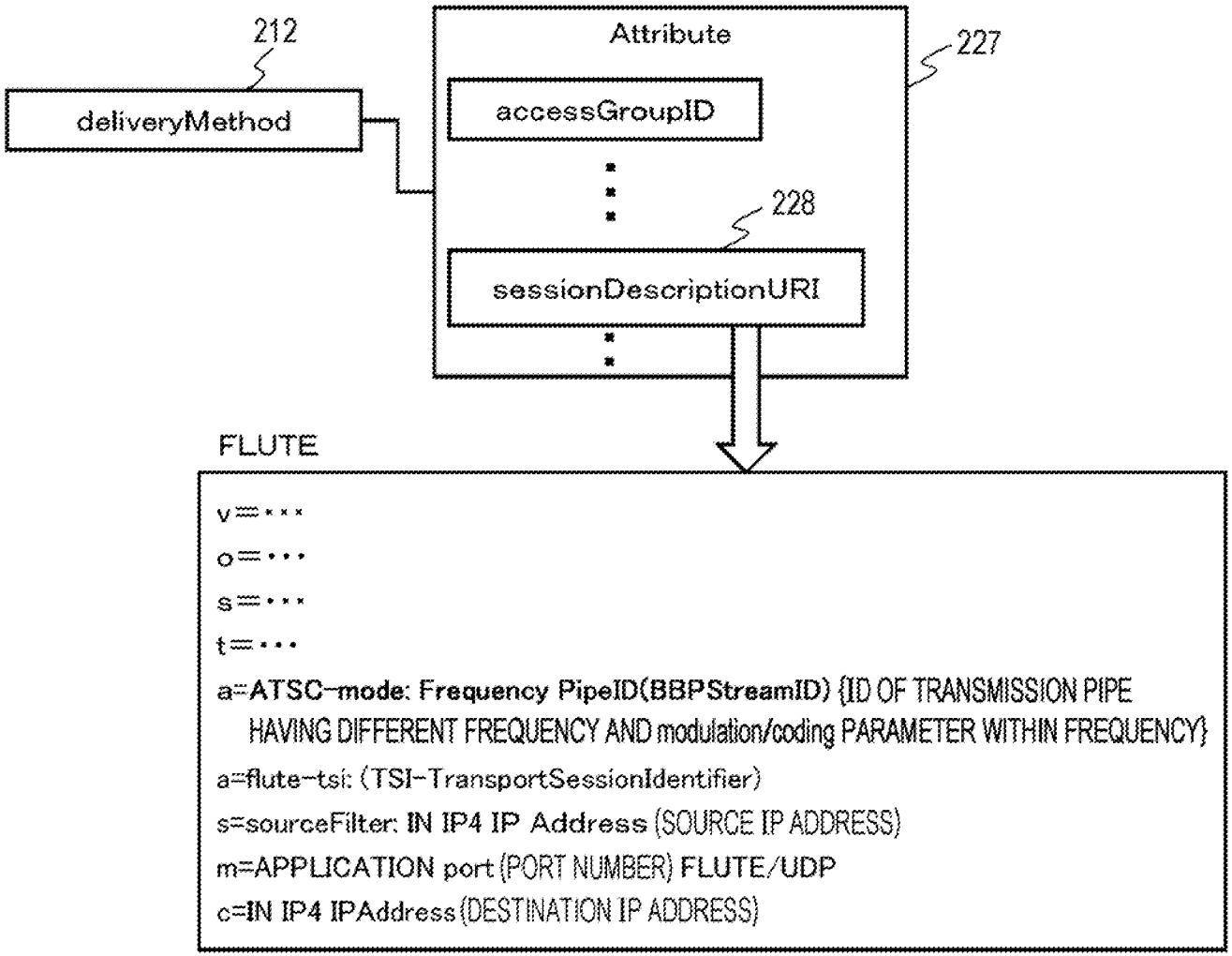
FIG. 16 is a diagram illustrating an example of reference information to FLUTE set in a delivery method (deliveryMethod) element when file transfer is performed according to a FLUTE protocol.

FIG. 16 is a diagram illustrating an example of reference information to FLUTE set in the delivery method (deliveryMethod) element 212 when the file transfer is performed according to the FLUTE protocol.

The following information illustrated in FIG. 16 is recorded as an SDP referred to from a session description URI (sessionDescriptionURI) attribute 228 among attributes 227 set below the delivery method (deliveryMethod) element 212 as illustrated in FIG. 16:

v= • • • o= • • • s= • • • t= • • • a=ATSC-mode: Frequency PipeID (BBPStreamID) {ID of transmission pipe having different frequency and modulation/coding parameter within frequency} a=flute-tsi: (TSI-TransportSessionIdentifier)

s=sourceFilter: IN IP 4 IP Address (source IP address)

m=APPLICATION port (port number) FLUTE/UDP c=IN IP4 IPAddress (destination IP address)

Figure 17:
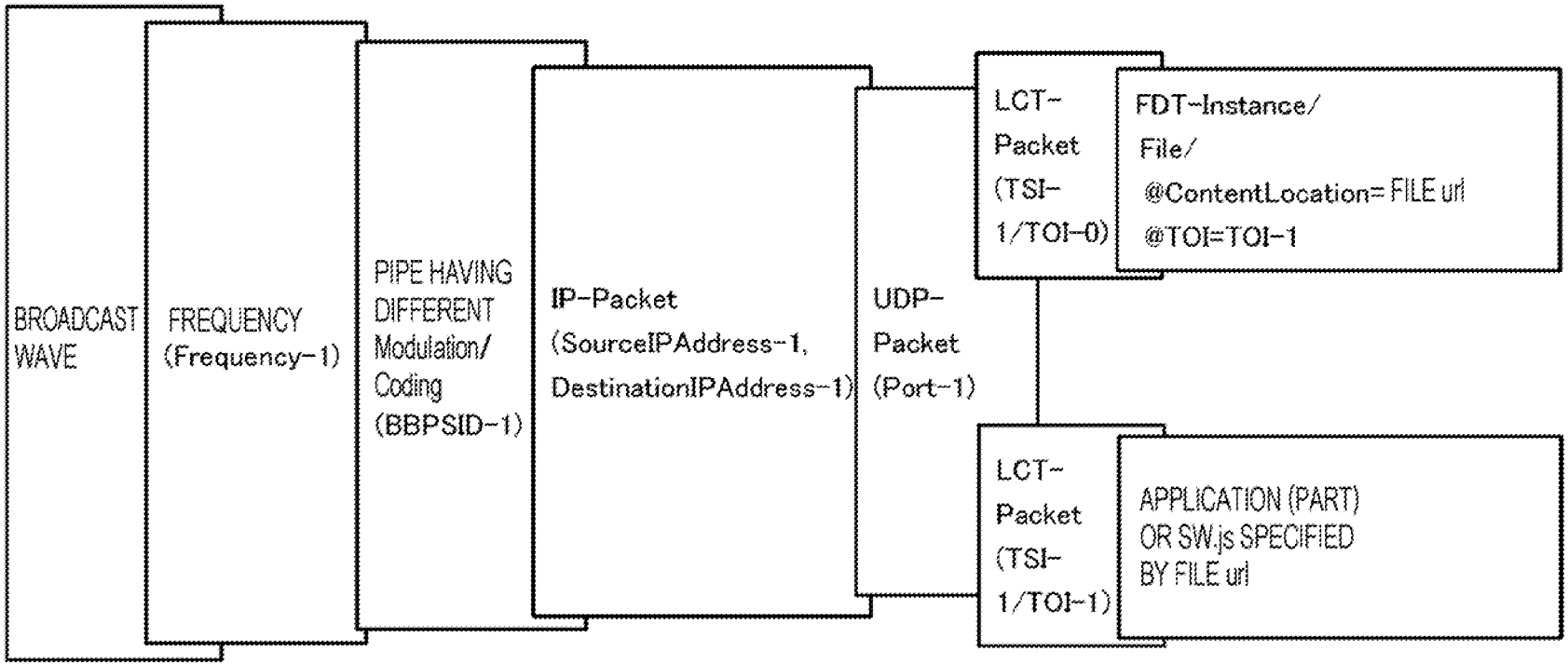
FIG. 17 is a diagram illustrating an example of reference information to FLUTE set in a delivery method (deliveryMethod) element when file transfer is performed according to a FLUTE protocol.

FIG. 17 illustrates a file specifying configuration specified according to the above information.

All files transferred according to the FLUTE (ROUTE) protocol are stored in an LCT packet on a UDP packet on an IP packet and transferred.

In the case of FLUTE, the file is specified by an source IP address (SourceIPAddress), a destination IP address (DestinationIPAddress), a port number (Port), and TSI which are indicated by the SDP. This is performed in units of FLUTE sessions).

The source IP address (SourceIPAddress) and the destination IP address (DestinationIPAddress) are used to specify the IP packet, the port number (Port) is used to specify the UDP packet, and the TSI is used to specify the LCT packet string.

Further, a desired file is specified by TOI (TransportObjectIdentifier) stored in the LCT packet.

A file description table (FDT) is stored in an LCT packet in which the TOI is 0, and a relation between each file URL (stored in FDT-instance/File/@ContentLocation) and a corresponding TOI (stored in FDT-instance/File/@TOI) is resolved for other file objects in the transport session specified by the same TSI.

Figure 18:
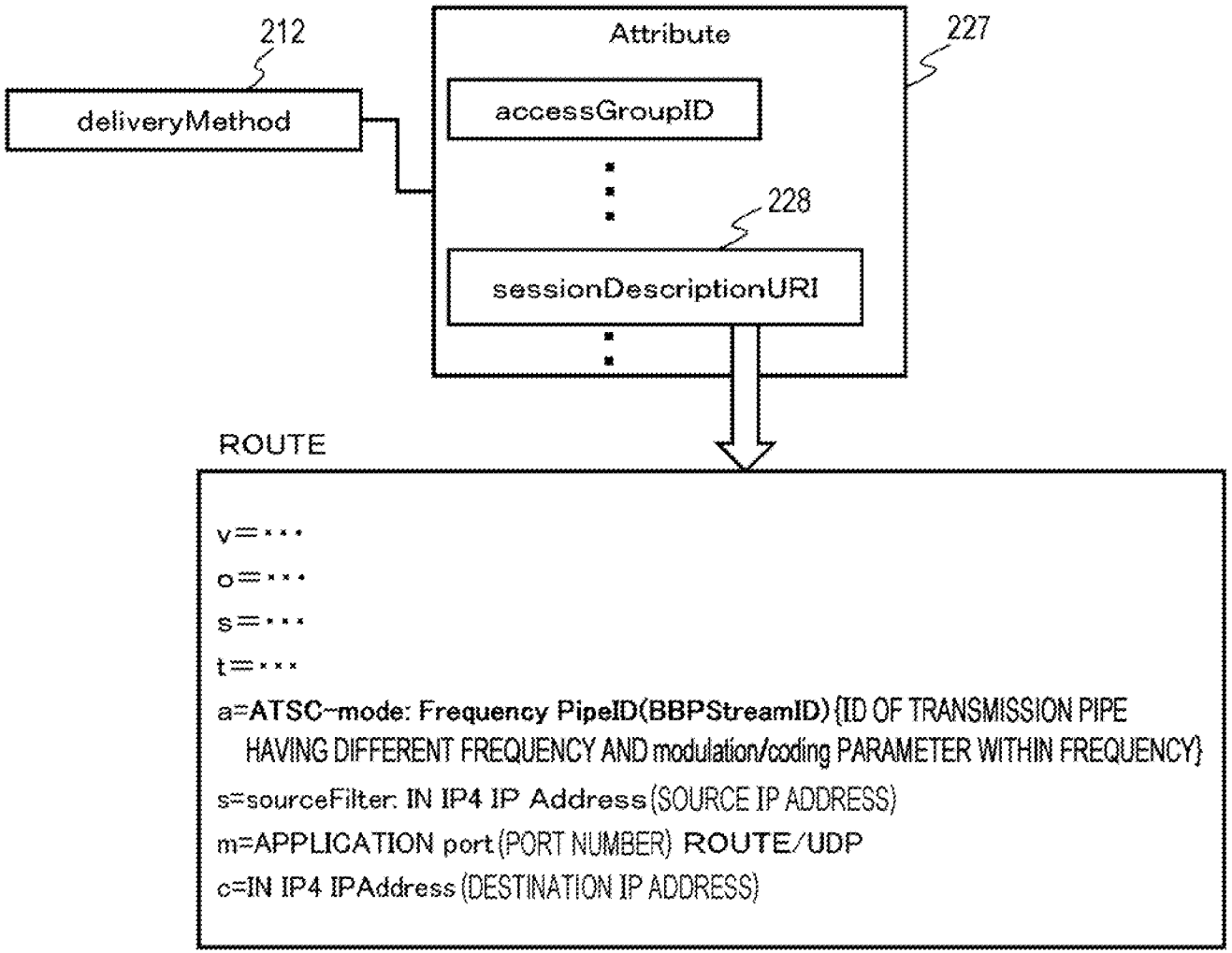
FIG. 18 is a diagram illustrating an example of reference information to FLUTE set in a delivery method (deliveryMethod) element when file transfer is performed according to a ROUTE protocol.

On the other hand, FIG. 18 is a diagram illustrating an example of reference information to FLUTE set in the delivery method (deliveryMethod) element 212 when the file transfer is performed according to the ROUTE protocol.

The following information illustrated in FIG. 18 is recorded as the SDP referred to from the session description URI (sessionDescriptionURI) attribute 228 among the attributes (Attribute) 227 set below the delivery method (deliveryMethod) element 212 as illustrated in FIG. 18:

v= • • • o= • • • s= • • • t= • • • a=ATSC-mode: Frequency PipeID (BBPStreamID) {ID of transmission pipe having different frequency and modulation/coding parameter within frequency} s=source Filter: IN IP 4 IP Address (source IP address)

m=APPLICATION port (port number) ROUTE/UDP c=IN IP4 IPAddress (destination IP address)

Figure 19:
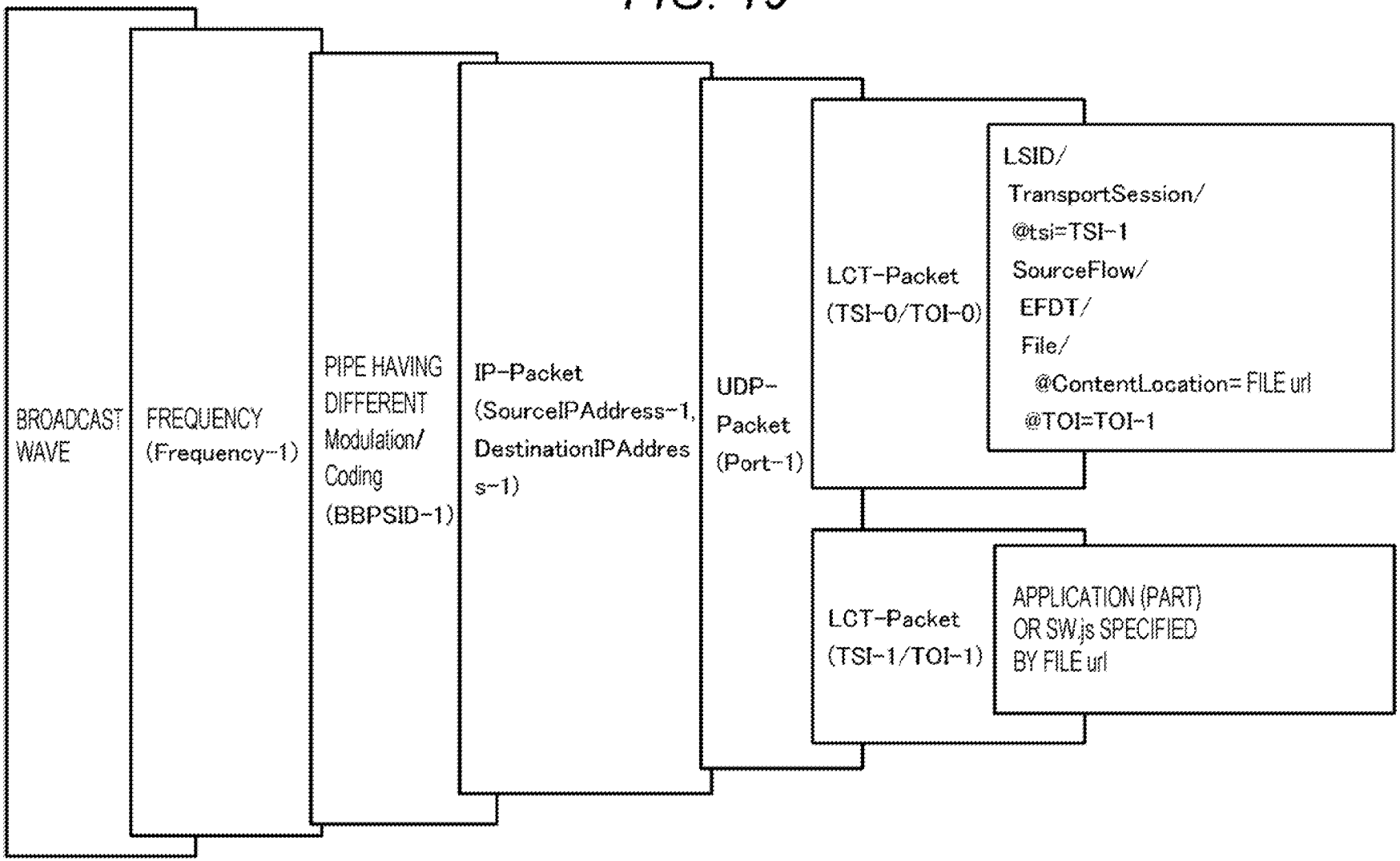
FIG. 19 is a diagram illustrating an example of reference information to FLUTE set in a delivery method (deliveryMethod) element when file transfer is performed according to a ROUTE protocol.

FIG. 19 illustrates a file specifying configuration specified according to the above information.

In the case of ROUTE, the file is specified by an source IP address (SourceIPAddress), a destination IP address (destinationIPAddress), and a port number (Port) which are indicated by the SDP. This is performed in units of ROUTE sessions.

The source IP address (SourceIPAddress) and the destination IP address (destinationIPAddress) are used to specify the IP packet, and the port number is used to specify the UDP packet.

In the ROUTE session, an LCT session instance description (LSID) is stored in an LCT packet in which the TSI of the LCT packet is 0, and the TOI is 0, and attributes for other transport sessions (specified by the TSI of the LCT packet) in the ROUTE session are stored. A relation between a ContentLocation attribute serving as an attribute of a TransportSession/SourceFlow/EFDT/File element of the LSID and a TOI corresponding to a file URL by the TOI attribute is resolved.

As described above with reference to FIG. 12, the signaling data (metadata) has the following three layers as illustrated in FIG. 12:

(1) the service layer (OMA-ESG)

(2) the file transfer session layer (3GPP-MBMS-USD)

(3) the FLUTE (ROUTE) parameter layer (FLUTE (ROUTE))

The FLUTE (ROUTE) parameter layer (FLUTE (ROUTE)) includes an FDT (FDT-instance) element of FLUTE in which the entire file transfer session is described or a file element in which an attributes of each file carried in the session is described. The file URL is stored in the content location (Content-Location) attribute which is the attribute of the file element.

Figure 20:
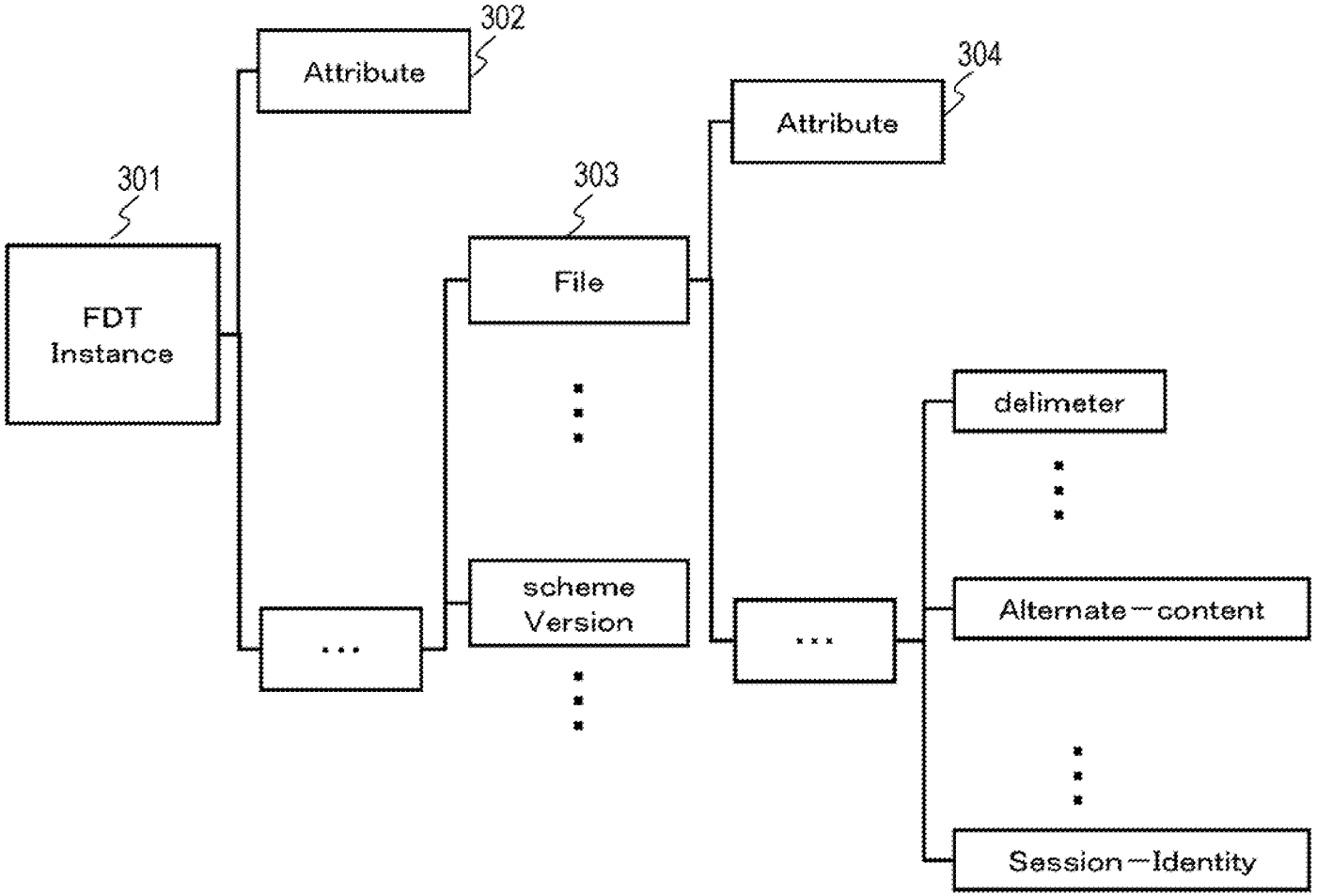
FIG. 20 is a diagram for describing a configuration of an FDT-instance element.

FIG. 20 is a diagram illustrating a data storage configuration below the FDT instance element in the FLUTE (ROUTE) parameter layer constituting the signaling data.

Below an FDT instance element 301, set are an attribute 302 corresponding to the FDT instance, and a file element 303.

Further, below the file element 303, set is an attribute 304 corresponding to a file.

Figure 21B:
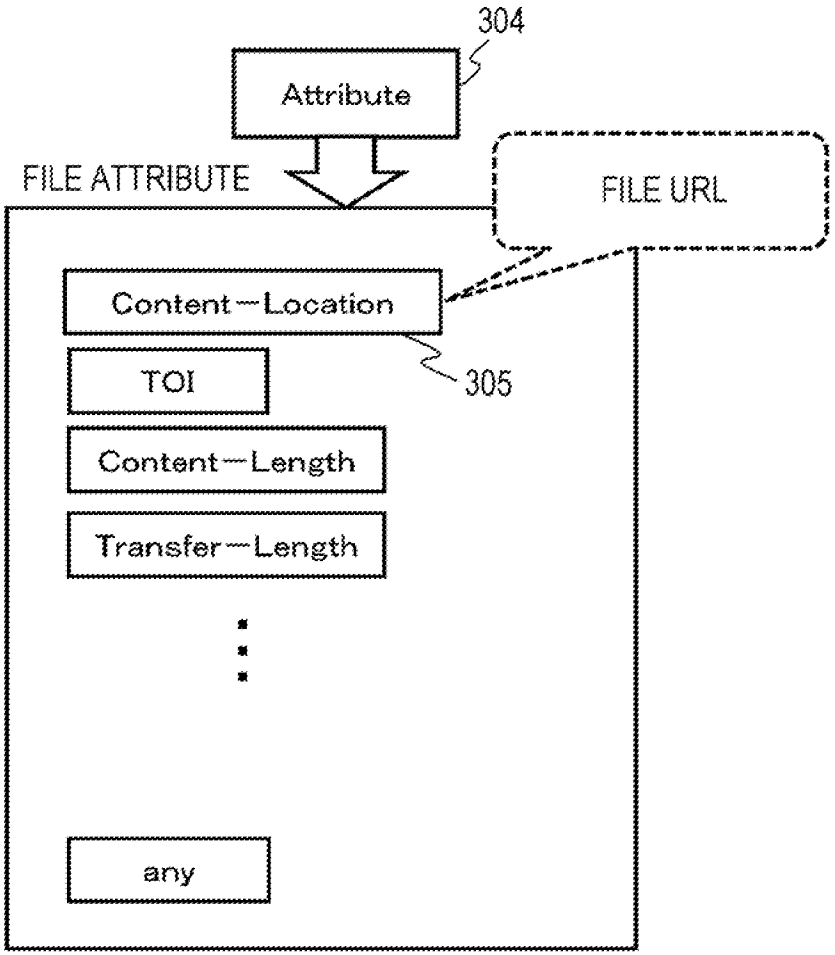
FIGS. 21(*a*) and 21(*b*) are diagrams for describing a detailed configuration of an attribute corresponding to an FDT instance and an attribute corresponding to a file respectively.
Figure 21A:
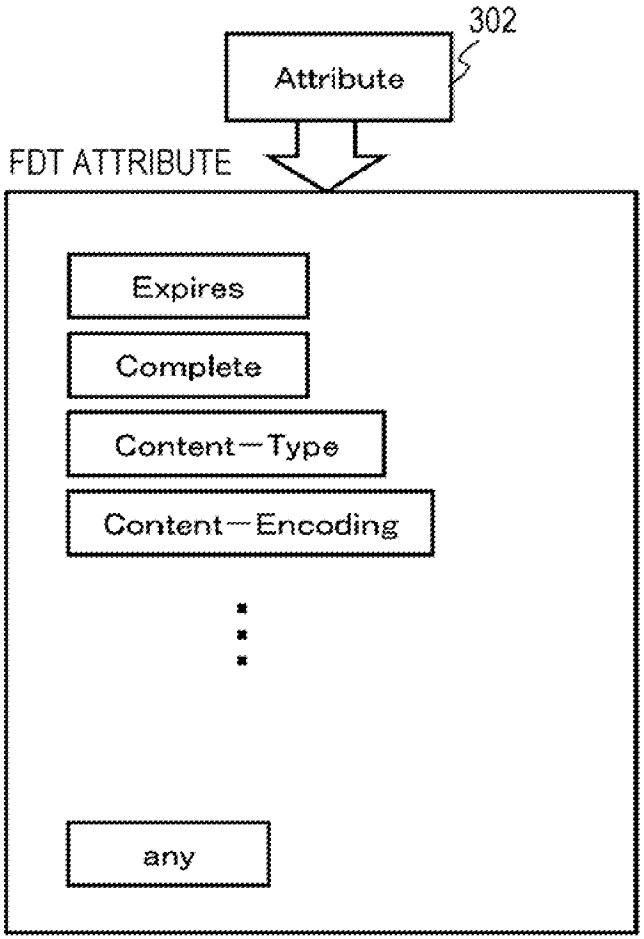

FIGS. 21 (*a*) and 21 (*b*) illustrate detailed configurations of the attribute 302 corresponding to the FDT instance and the attribute 304 corresponding to the file.

The file URL is stored in a content location (Content-Location) attribute recording region 305 set in the attribute 304 corresponding to the file as illustrated in FIGS. 21(*a*) and 21(*b*).

On the other hand, for ROUTE, the file element specified in FLUTE is stored in the LSID serving as the signaling data specified in ROUTE.

Figure 22:
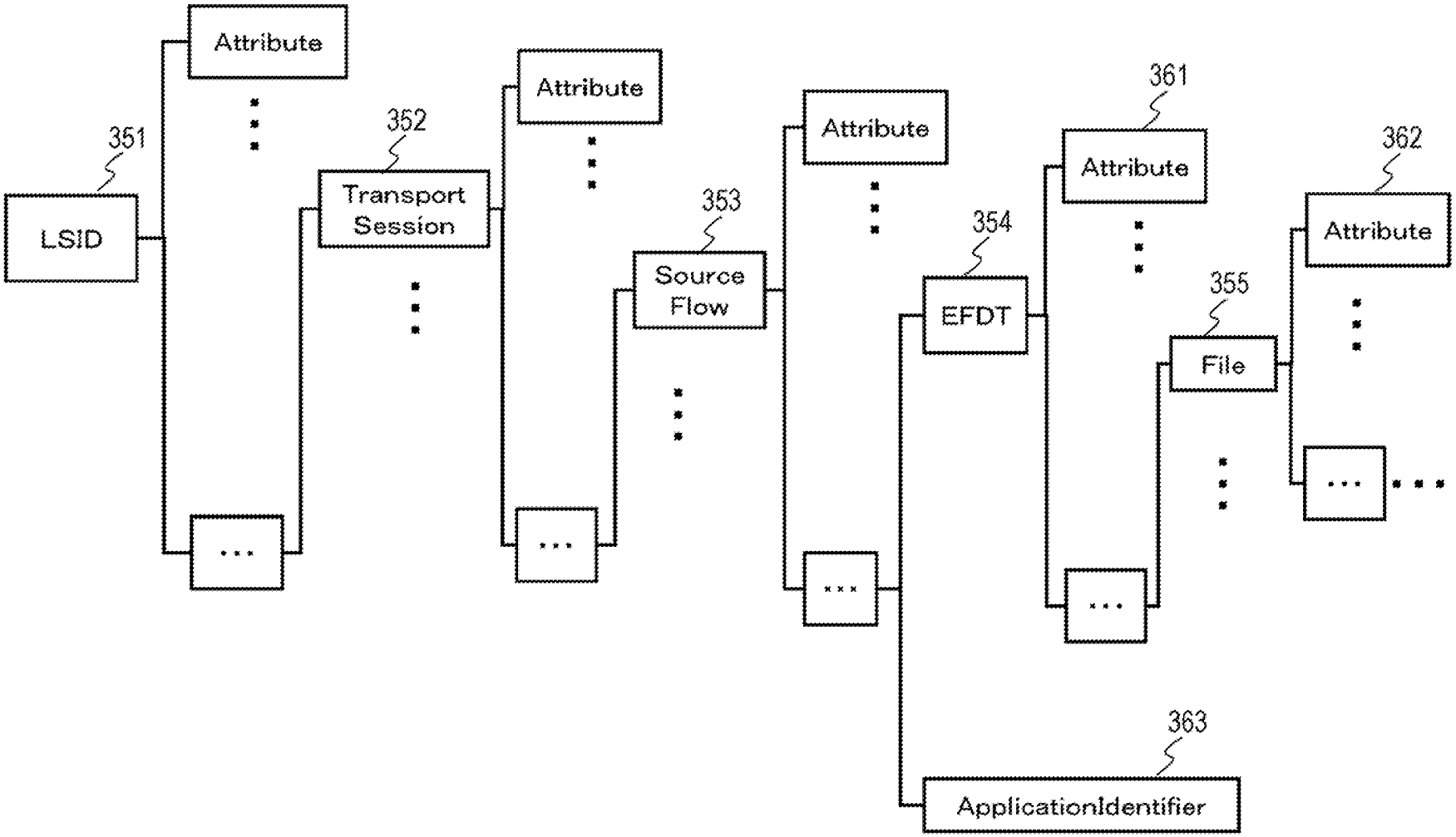
FIG. 22 is a diagram illustrating a data configuration below LSID specified in ROUTE.

FIG. 22 illustrates a data configuration below the LSID specified in ROUTE.

As illustrated in FIG. 22, a hierarchical setting is performed as follows:

an LSID element 351;

a transport session (TransportSession) element 352;

a source flow (SourceFlow) element 353;

an EFDT element 354; and a file element 355.

As illustrated in FIG. 22, in the case of ROUTE, as an data element in which the entire file transfer session is described, LSID/TransportSession/SourceFlow/EFDT element is set, and further, there is a file element 355 in which an attribute of each file carried in the session is described. This is the same as the file element in the case of FLUTE described above.

The file URL is stored in the content location (Content-Location) attribute recording region which is the attribute of the file element 355.

Figure 23B:
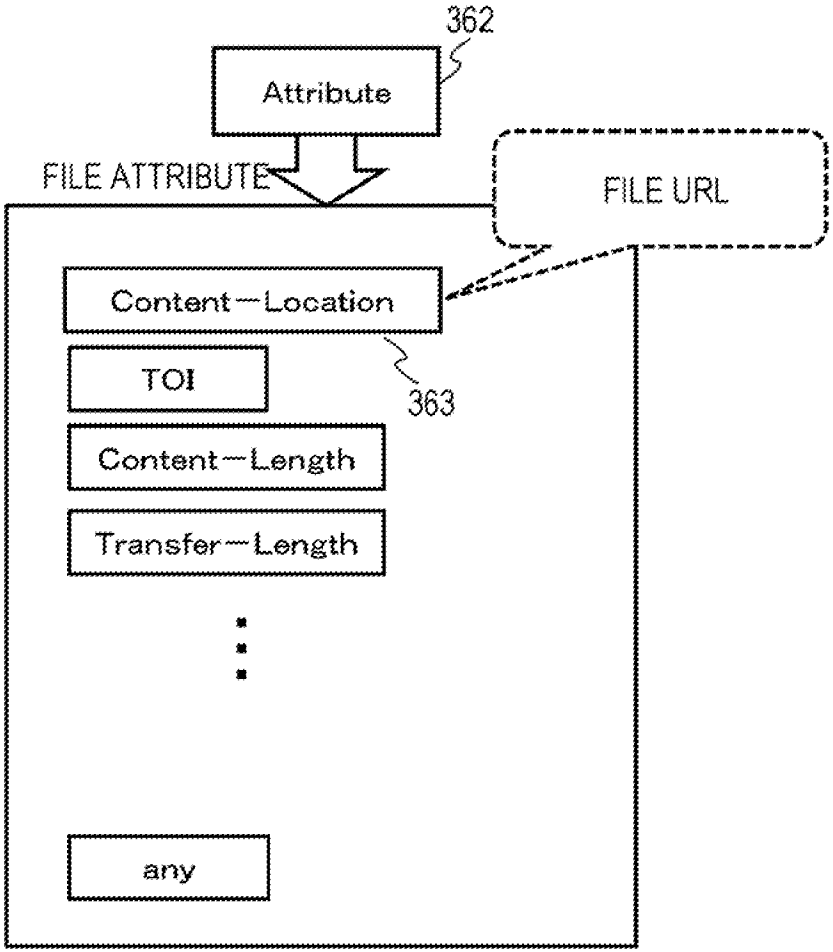
FIGS. 23(*a*) and 23(*b*) are diagrams for describing the details of an attribute data element in an EFDT element unit and an attribute data element of a file unit respectively.
Figure 23A:
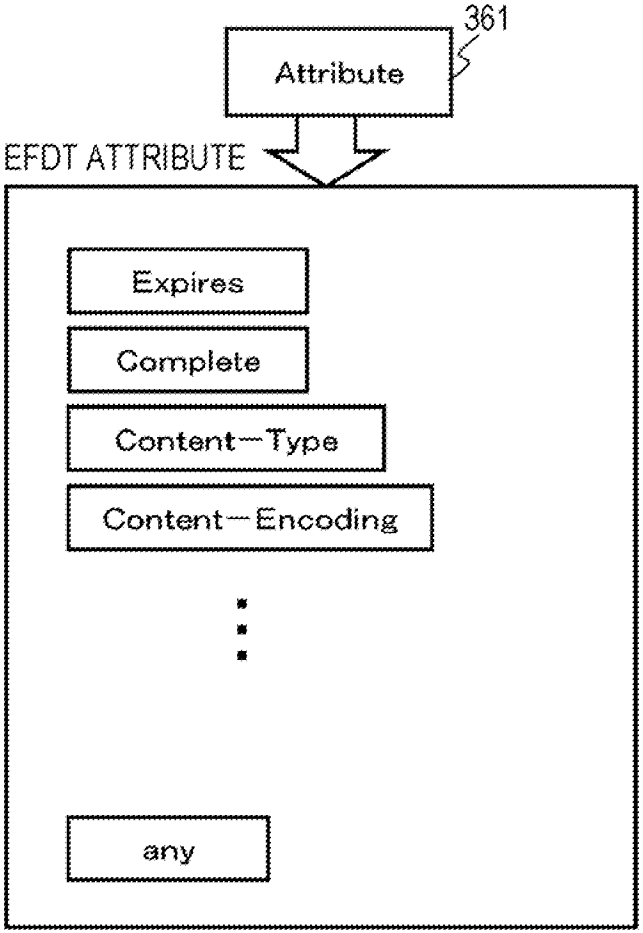

FIGS. 23 (*a*) and 23 (*b*) illustrate detailed configurations of the attribute recording regions illustrated in FIG. 22, that is, (a) the attribute data element 361 of the EFDT element 354 unit and (b) the attribute data element 362 of the file 355 unit.

The file URL is recorded in a content location (Content-Location) attribute recording region 363 in the attribute 362 corresponding to the file as illustrated in FIGS. 23(*a*) and 23(*b*).

The middleware of the reception device (client) 30 analyzes (parses) the FDT (FDT-instance) when the communication protocol is FLUTE. When the communication protocol is ROUTE, the middleware of the reception device (client) 30 can analyze (parse) the LSID and detect the file URL transferred through the file transfer session.

The reception device (client) 30 checks which of the base pattern recording regions 225 and 226 of the USD described above with reference to FIG. 15 an upper-level portion of the path of the URL on the basis of the file URL is recorded in.

In other words, it is possible to determine whether delivery is broadcast stream delivery or network delivery by checking which of the following recording regions it is included in:

the base pattern recording region 225=[r12: broadcastAppService/basePattern]; and the base pattern recording region 226=[r12: unicastAppService/basePattern]

below bundleDescription/userServiceDescription/deliveryMethod.

When it is included in the base pattern recording region 225, the broadcast stream delivery is performed.

When it is included in the base pattern recording region 226, the delivery via the network is performed.

Note that, when it is included in both the base pattern recording regions 225 and 226, it indicates that the delivery via the network is performed along with the broadcast stream delivery.

[9. Control of Redirection Policy]

Next, a configuration for controlling whether or not data delivery via broadcasting or data delivery via a network is received according to the reception device (device), the user thereof, a data delivery time zone, or the like will be described.

As described above, the reception device 30 can obtain the file URL which is scheduled to be acquired on the basis of the data recorded in the user service description (USD) which is the signaling data transmitted from the transmission device and acquire a predetermined data file (content, an application, a service worker (SW), or other data file) using the obtained file URL.

For example, when an application on the browser of the reception device 30 makes a file acquisition request using a certain file URL, if a target file is delivered via broadcasting, the URL base pattern is acquired from the base pattern recording region 225 described above with reference to FIG. 15.

In other words, the URL base pattern is acquired from the base pattern recording region 225=[r12: broadcastAppService/basePattern]

below bundleDescription/userServiceDescription/deliveryMethod.

The path (the whole path or a part from the head) of the file URL is stored in the base pattern recording region 225. In this case, the address resolution unit (broadcast/broadband address resolver) 123 of the HTTP proxy server 120 illustrated in FIG. 7 performs a setting for acquiring the file from the broadcast stream and does not perform acquisition via the network.

FIG. 24(1) illustrates an example of the recording information of the USD in the case of delivery via broadcasting and the URL of the file that can be acquired via broadcasting.

On the other hand, for example, when an application on the browser of the reception device 30 makes a file acquisition request using a certain file URL, if a target file is delivered via the network, the URL base pattern is acquired from the base pattern recording region 226 described above with reference to FIG. 15.

In other words, the URL base pattern is acquired from the base pattern recording region 226=[r12: unicastAppService/basePattern]

below bundleDescription/userServiceDescription/deliveryMethod.

The path (the whole path or a part from the head) of the file URL is stored in the base pattern recording region 226. In this case, the address resolution unit (broadcast/broadband address resolver) 123 of the HTTP proxy server 120 illustrated in FIG. 7 performs the file acquisition via the network.

FIG. 24(2) illustrates an example of the recording information of the USD in the case of delivery via the network and the URL of the file that can be acquired via the network.

Note that, when the path (the whole path or a part from the head) of the file URL can be acquired from both the base pattern recording region 225 and the base pattern recording region 226, the address resolution unit (broadcast/broadband address resolver) 123 of the HTTP proxy server 120 illustrated in FIG. 7 makes an attempt to acquire the file from the broadcast stream, but for example, when the acquisition via the network is faster than completion of the file acquisition via broadcasting (for example, when there is a margin in a network bandwidth, and resources of a network configuration device on a network path or an available capacity of a file server is sufficient), there are cases in which the acquisition is performed via the network, and it responds to a request source client application as well.

[9.1. Delivery Data Acquisition Permission Example 1 Via Network]

Next, a configuration of performing control such that reception of the data file to be delivered via the network, for example, resources (the application file or the application-associated data file) serving as the management target of the service worker (SW) or other files (content, the application, the service worker (SW), or other data file) is permitted or not permitted according to the reception device or the user thereof will be described.

A class (group) is assigned to the reception device (client) 30 or the user who owns the reception device (client) 30.

It is controlled whether or not the file can be acquired via the network according to the class.

In other words, control is performed using signaling data in which class information indicating a group of reception devices or users that are permitted to perform data reception via the network.

Figure 25:
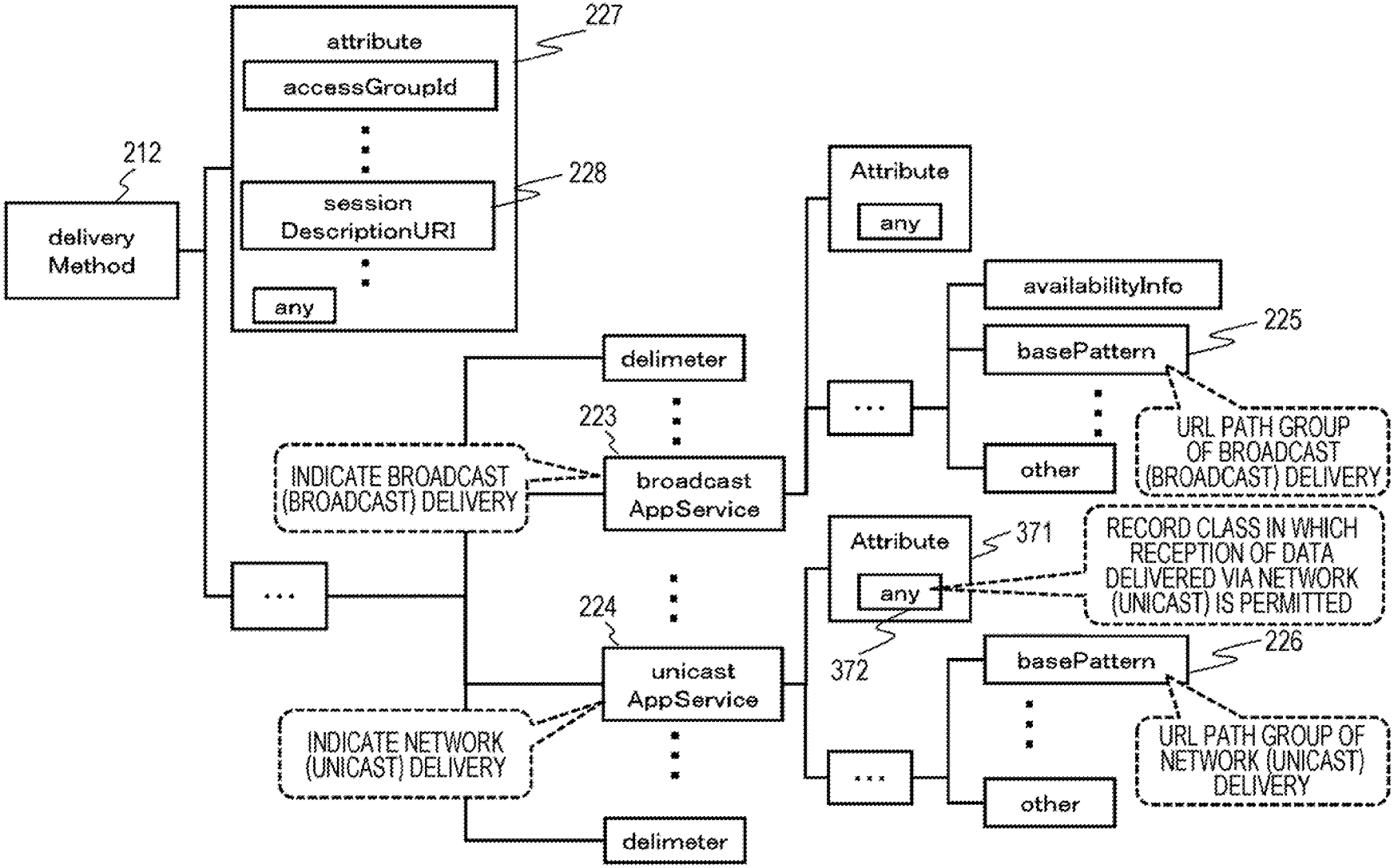

For this control, network delivery data reception permitted class (permittedClass) attribute information is recorded in a data recording region (any) 372 of an attribute recording region 371 set in the unicast application service (unicastAppservice) element 224 which is a subordinate element of the delivery method (deliveryMethod) element in the USD illustrated in FIG. 25.

It is because depending on a delivery service provider, there are operational requirements in which access via a network is desired to be permitted to only the users (devices) of a premium class when the resources of the network configuration device on the network path or an available capacity of the file server are not sufficient.

For example, an XML schema definition of the network delivery data reception permitted class (permittedClass) attribute is assumed to be the following definition:

```
<xs:attribute name="permittedClass" type="stringListType"
xmlns:xs="http://www.w3.org/2001/XMLSchema"/>
<xs:simpleType name="stringListType"
xmlns:xs="http://www.w3.org/2001/XMLSchema">
<xs:list itemType="xs:string">
</xs:simpleType>
```

On the basis of the above definition, the following class identifier is stored as a class identifier of a class to which the access via the network is permitted:

<unicastAppService permittedClass="classN, classM">

Figure 26:
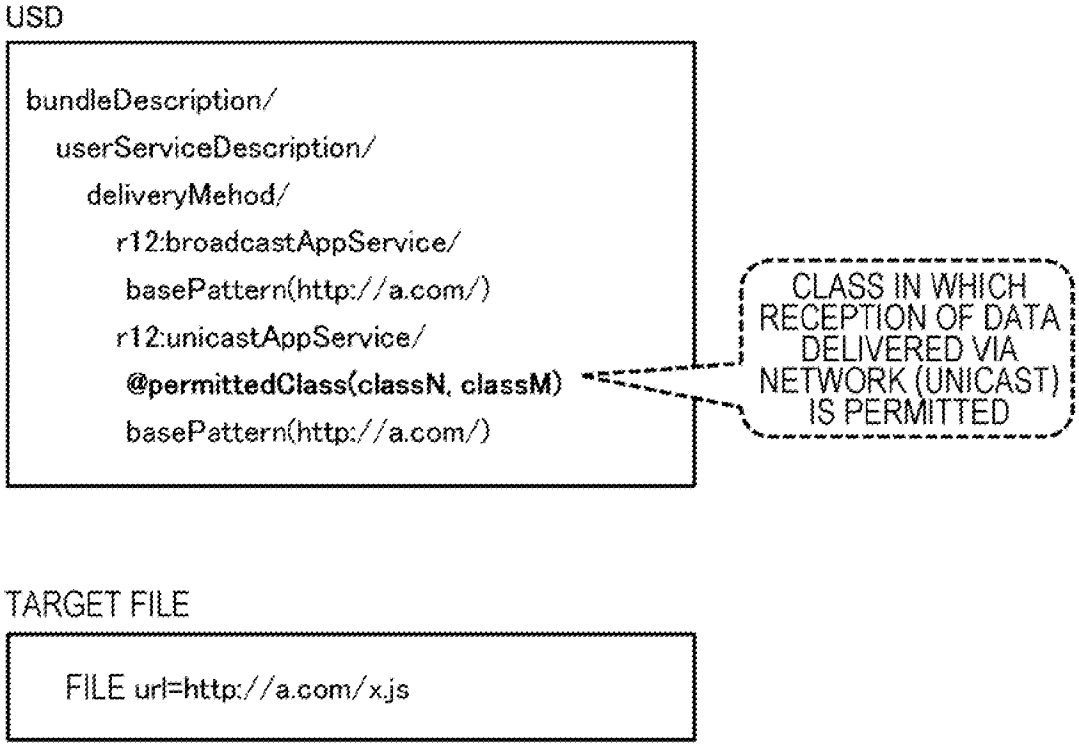

For example, when USD including signaling data illustrated in FIG. 26 is set and delivered, only the reception device (client) or the user to which a class N (classN) or a class M (classM) recorded in the USD is assigned can acquire the file even via the network.

For example, the address resolution unit (broadcast/broadband address resolver) 123 of the HTTP middleware 120 that has received the file acquisition request from the application being performed by the reception device (client) 30 performs the access via the network only when the classN or the classM is assigned to itself, for example, with reference to the class of the reception device (device) or the user using the device by the API. Devices to which the classes are not assigned can use only the delivery via broadcasting.

Note that the class information is recorded in the memory of the reception device as registration information, and the API refers to the registration information.

Note that, for a class setting, for example, classification based on various conditions such as classification according to a region unit in which the reception device or the user is located or classification according to device information or user information which is registered in advance can be performed.

[9.2. Delivery Data Acquisition Permission Example 2 Via Network]

For a configuration of performing control such that reception of the data file to be delivered via the network, for example, resources (the application file or the application-associated data file) serving as the management target of the service worker (SW) or other files (content, the application, the service worker (SW), or other data file) is permitted or not permitted according to the reception device or the user thereof, in addition to the above configuration, a method of delivering a plurality of pieces of USD and assigning the USD to the class corresponding to the reception device (device) or the user is also considered.

Figure 27:
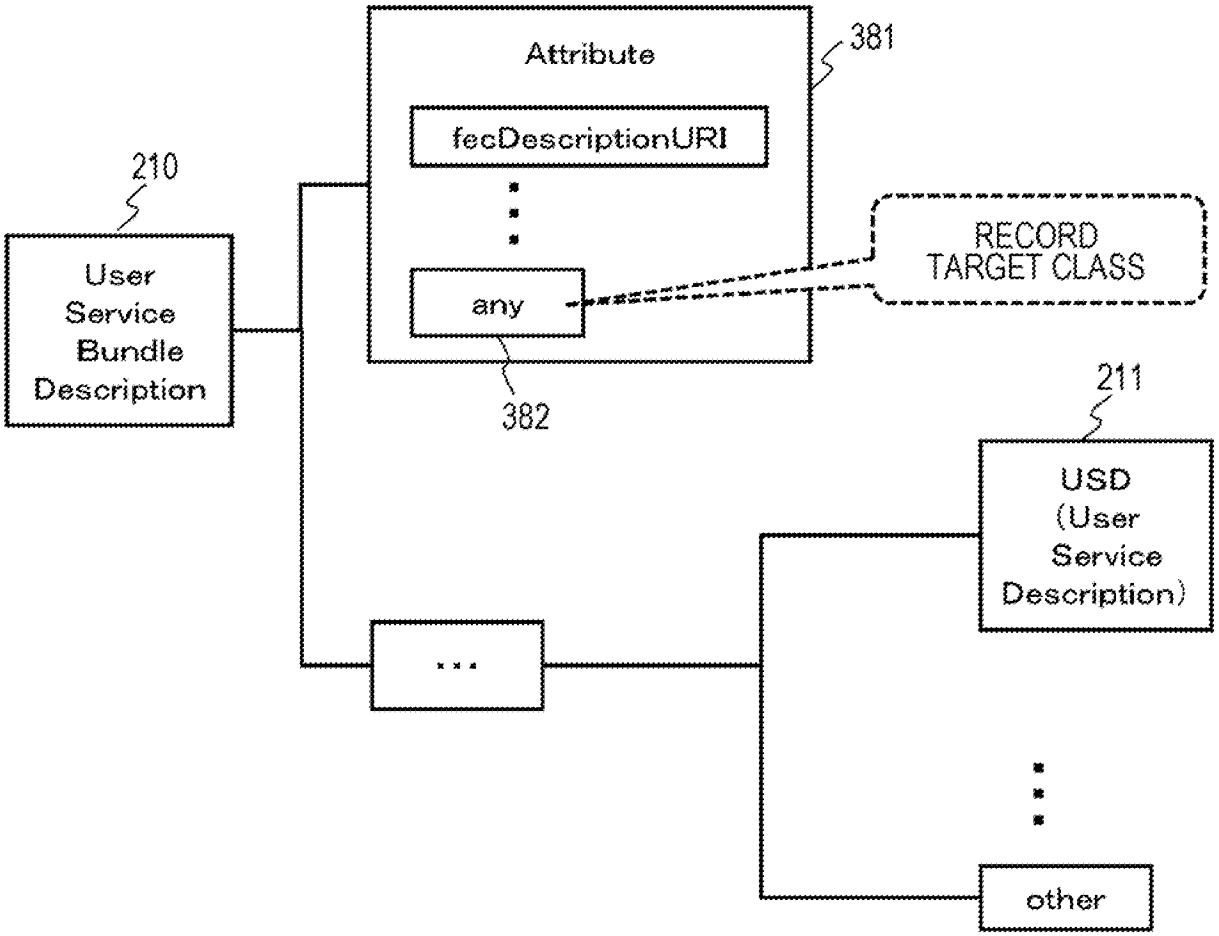

In this case, a target class (targetClass) attribute is recorded in a data recording field (any) 382 in an attribute data recording region 381 below a user service bundle description (UserServicebundleDescription) element which is a root element of the USD element as illustrated in FIG. 27.

The target class (targetClass) indicates a class associated with the reception device (client device) or the user that is permitted to receive the data file corresponding to the signaling data recorded in the user service description (USD).

For example, an XML schema definition of the target class (targetClass) attribute is assumed to be the following definition:

```
<xs:attribute name="targetClass" type="stringListType"
xmlns:xs="http://www.w3.org/2001/XMLSchema"/>
<xs:simpleType
name="stringListType"xmlns:xs="ttp://www.w3.org/2001/XMLSchema"
<xs:list itemType="xs:string">
</xs:simpleType>
```

The definition is made as described above. The target class identifier is stored, for example, as the following setting:

<unicastAppService targetClass="classN, classM">

Figure 28:
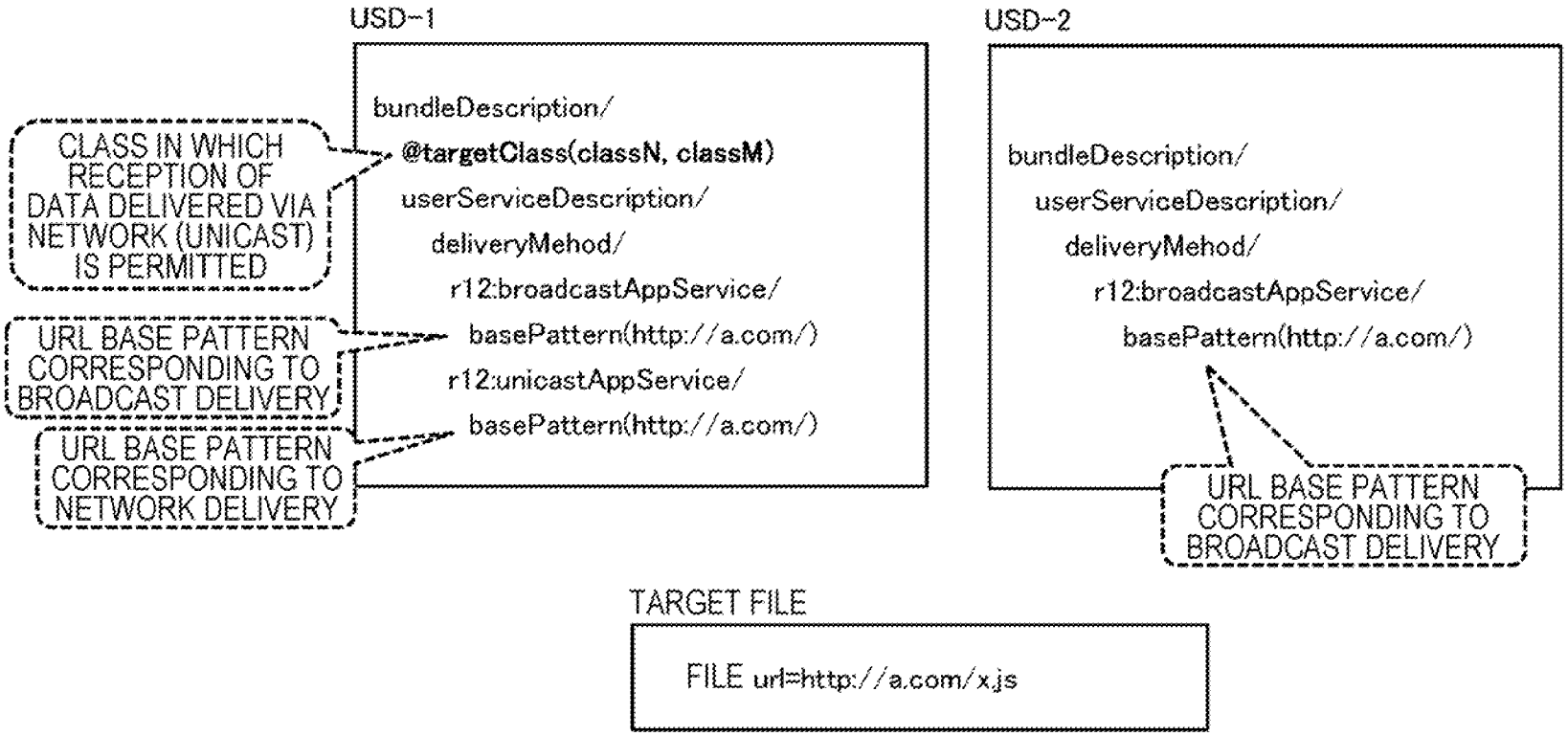

For example, when USD-1 and USD-2 including signaling data illustrated in FIG. 28 are set and delivered, only a group of the reception devices (client devices) or the users to which the class classN or the classM is assigned can use the USD-1 and acquire the file even via the network.

In the USD-1, the base pattern of the file URL corresponding to broadcast-delivered file is recorded, and the base pattern of the file URL corresponding to the network-delivered file delivered via the network is also recorded.

The reception device or the user of the class (the classN or the classM) that is permitted to use this USD-1 can use both the base pattern of the file URL corresponding to the broadcast-delivered file and the base pattern of the file URL corresponding to the network-delivered file which are obtained from the USD-1 and acquire the file both via broadcasting and via the network.

However, the reception device or the user other than the reception device or the user of the class (the classN or the classM) that is permitted to use the USD-1 can use only the USD-2.

Only the base pattern of the file URL corresponding to the broadcast-delivered file is recorded in the USD-2.

Therefore, the reception device or the user other than the reception device or the user of the class (the classN or the classM) can use only the base pattern of the file URL corresponding to the broadcast-delivered file obtained from the USD-2 and acquire the file only via broadcasting.

Note that the class set in the reception device of the classN or M that can use the USD-1 can be assigned in various forms.

For example, the class can be set according to a device capability for permitting data acquisition via the network, for example, a device in which there is no sufficient space in the cache unit 121 which is a cache in which the broadcast-delivered file is stored in the HTTP proxy server 120 illustrated in FIG. 7 is set as the classN or M.

Alternatively, the class (that changes momentarily) may be assigned depending on state information that changes momentarily such as a congestion state of the network of the user of the device (a home local area network to which the device is directly connected or an access network between the home and a core network of a network provider).

Further, the class assignment may be performed to reflect an acquisition instruction tendency of the end user of the device (for example, a tendency in which it always relies on broadcast delivery or a tendency in which access via a network is always selected).

As described above, there are various class categories, and it is possible to flexibly change and set a characteristic of the target device in which the USD is used.

[9.3. Delivery Data Acquisition Permission Example 3 Via Network]

A data file delivered via the network, for example, a resource (application file, application data file) to be a management target by service worker (SW), or other file (content, application, service worker (SW), other data File) is permitted to be received or not permitted depending on the reception device and its user, in addition to the above-described configuration, it is possible to further control by the time zone.

Figure 29:
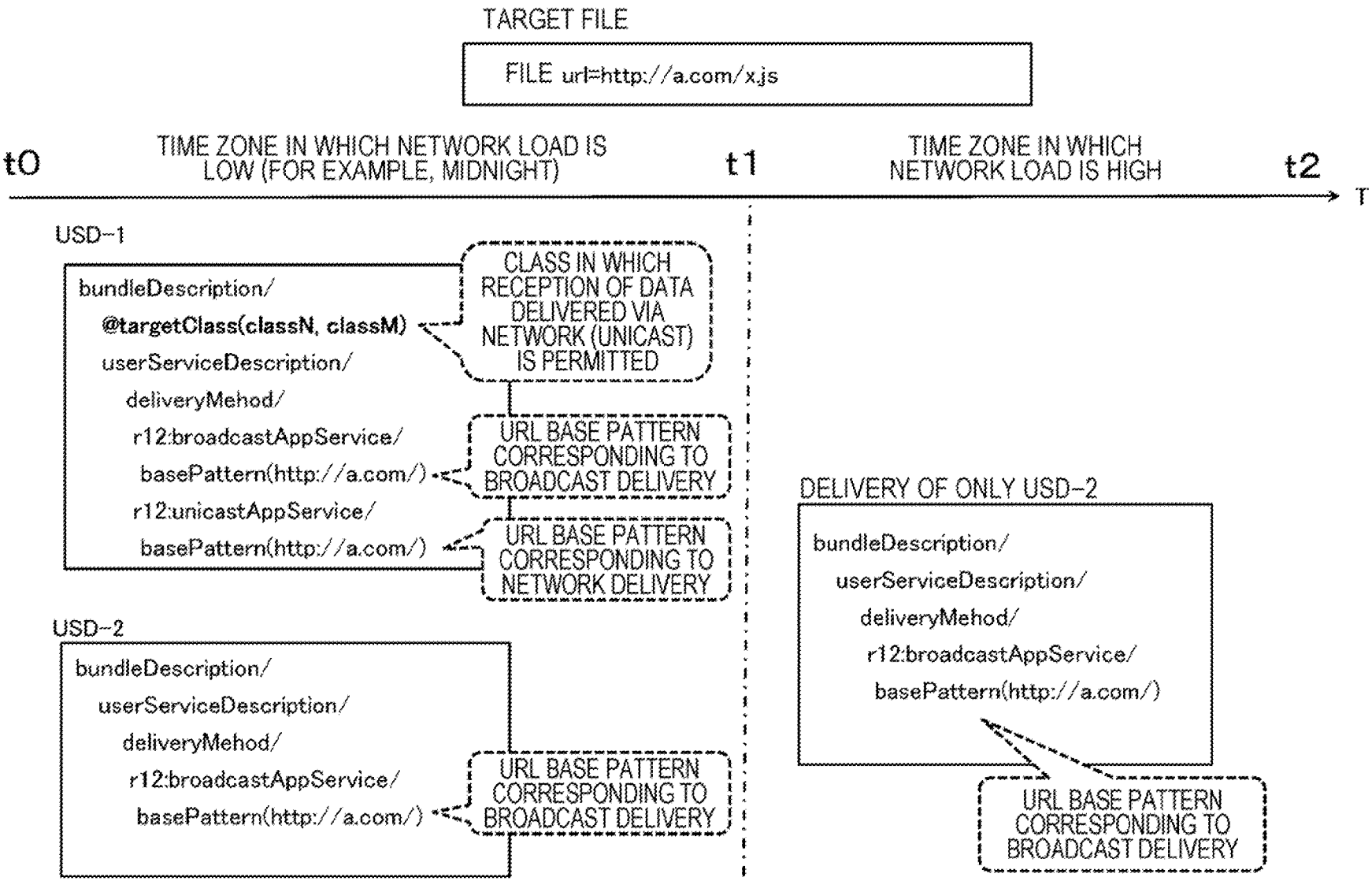

An example of the USD for implementing control according to a time zone is illustrated in FIG. 29.

The example illustrated in FIG. 29 is a setting for controlling the time zone in which the two USDs described above with reference to FIG. 28, that is, the USD-1 and the USD-2 are delivered.

A time axis that elapses from the left to the right is illustrated in FIG. 29.

Times t0 to t1 are, for example, a midnight, that is, a time zone in which a network load is relatively low.

Times t1 to t2 are a daytime, that is, a time zone in which a network load is relatively high.

In the time zone t0 to t1 in which the network load is relatively low, the two USDs, that is, the USD-1 and the USD-2 are delivered.

On the other hand, in the time zone t1 to t2 in which the network load is relatively high, only the USD-2 is delivered.

In the time zone t0 to t1 in which the network load is relatively low, the reception device (client) or the user associated with the class (the classN or M) that is permitted to use the USD-2 can acquire the file via the network.

On the other hand, in the time zone t1 to t2 in which the network load is relatively high, the USD-2 is not delivered, and all the reception devices (clients) perform the file acquisition via broadcasting.

As described above, it is possible to control the delivery route by changing the USD to be delivered according to the time zone.

Note that, since the USD signaling data is set so that the latest one is used when the reception device 30 uses the USD signaling data, it is possible to perform control depending on the time zone. The time zone and the configuration of the USD can be defined in advance, and an operation in which the configuration of the USD is dynamically changed according to a dynamic change of a network can be considered as well.

[10. Exemplary Configurations of Transmission Device and Reception Device]

Next, exemplary device configuration of the transmission device (server) 20 and the reception device (client) 30 which are communication devices will be described with reference to FIGS. 30 and 31.

Figure 30:
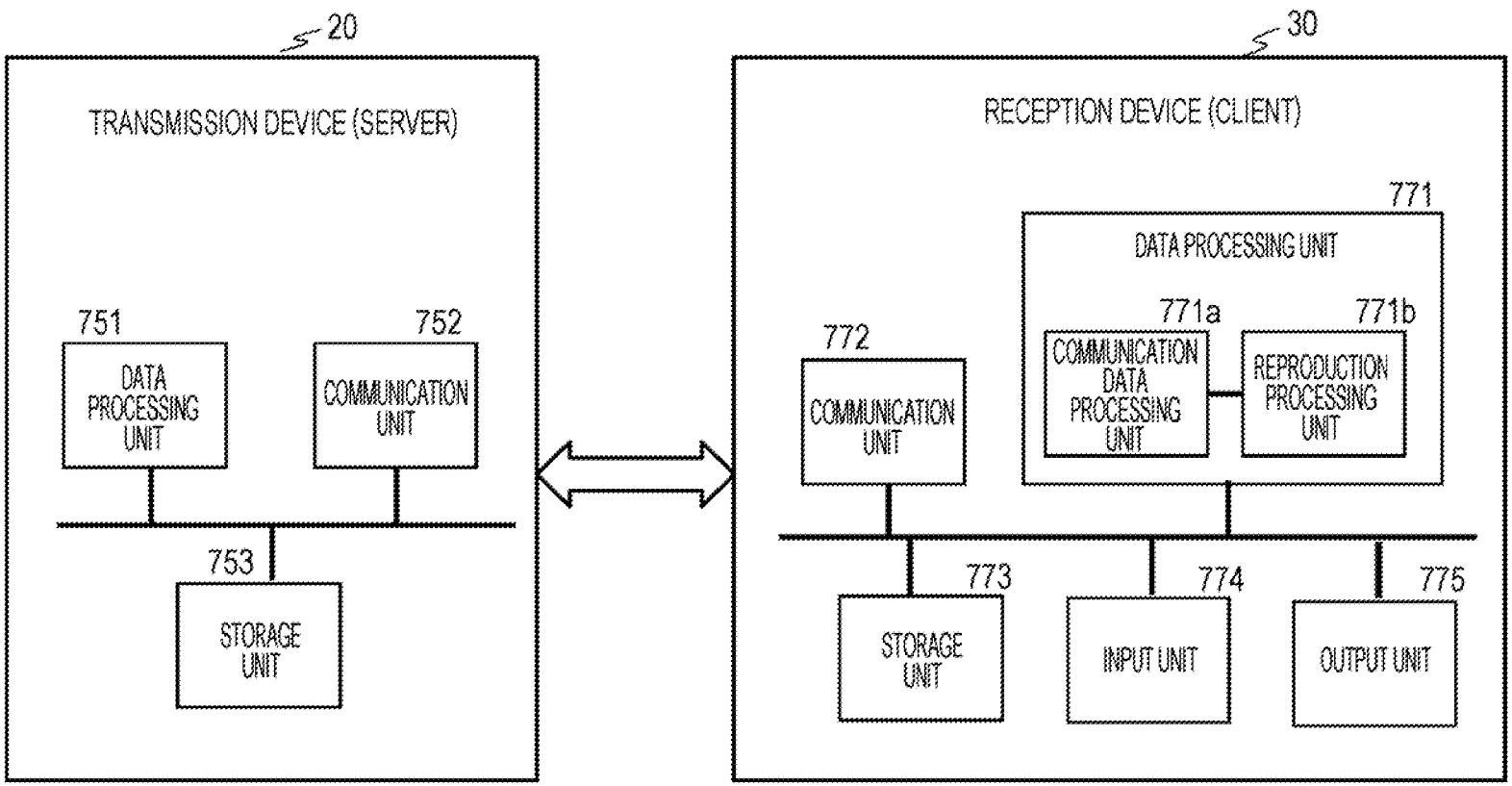

FIG. 30 illustrates exemplary configurations of the transmission device (server) 20 and the reception device (client) 30.

The transmission device (server) 20 includes a data processing unit 751, a communication unit 752, and a storage unit 753.

The reception device (client) 30 includes a data processing unit 771, a communication unit 772, a storage unit 773, an input unit 774, and an output unit 775.

The data processing unit includes a communication data processing unit 771*a* and a reproduction processing unit 771*b*.

The data processing unit 751 of the transmission device (server) 20 performs various data processing for executing the data delivery service. For example, the data processing unit 751 performs generation and transmission control of the configuration data of the data delivery service. Further, the data processing unit 751 performs generation and transmission processes of the application, the service worker (SW), various other data, and the signaling data to be provided to the reception device (client) 30.

The communication unit 752 performs communication processing such as delivery of the application, the service worker (SW), various other data, the signaling data, or the like in addition to the AV segment.

The storage unit 753 stores the AV segment, the application, and the service worker (SW) to be delivered, data used by the application, the signaling data, and the like.

Further, the storage unit 753 is used as a work area of data processing performed by the data processing unit 751 and also used as a storage region of various parameters.

On the other hand, the reception device (client) 30 includes a data processing unit 771, a communication unit 772, a storage unit 773, an input unit 774, and an output unit 775.

The communication unit 772 receives data delivered from the transmission device (server) 20, for example, the AV segment, the application, the service worker (SW), data to be used by the application, the signaling data, and the like.

The data processing unit 771 includes a communication data processing unit 771*a* and a reproduction processing unit 771*b*, and performs, for example, a process according to the above embodiment.

Specifically, the data processing unit 771 performs data processing using the application, the API, the service worker (SW), or the like.

An instruction command of the user, for example, various commands for channel selection, application activation, installation, and the like are input via the input unit 774.

Reproduction data is output to the output unit 775 such as a display unit or a speaker.

The storage unit 773 stores the AV segment, the service worker (SW), the application, data to be used by the application, the signaling data, and the like.

Further, the storage unit 773 is used as a work area of data processing performed by the data processing unit 771 and also used as a storage region of various parameters.

Figure 31:
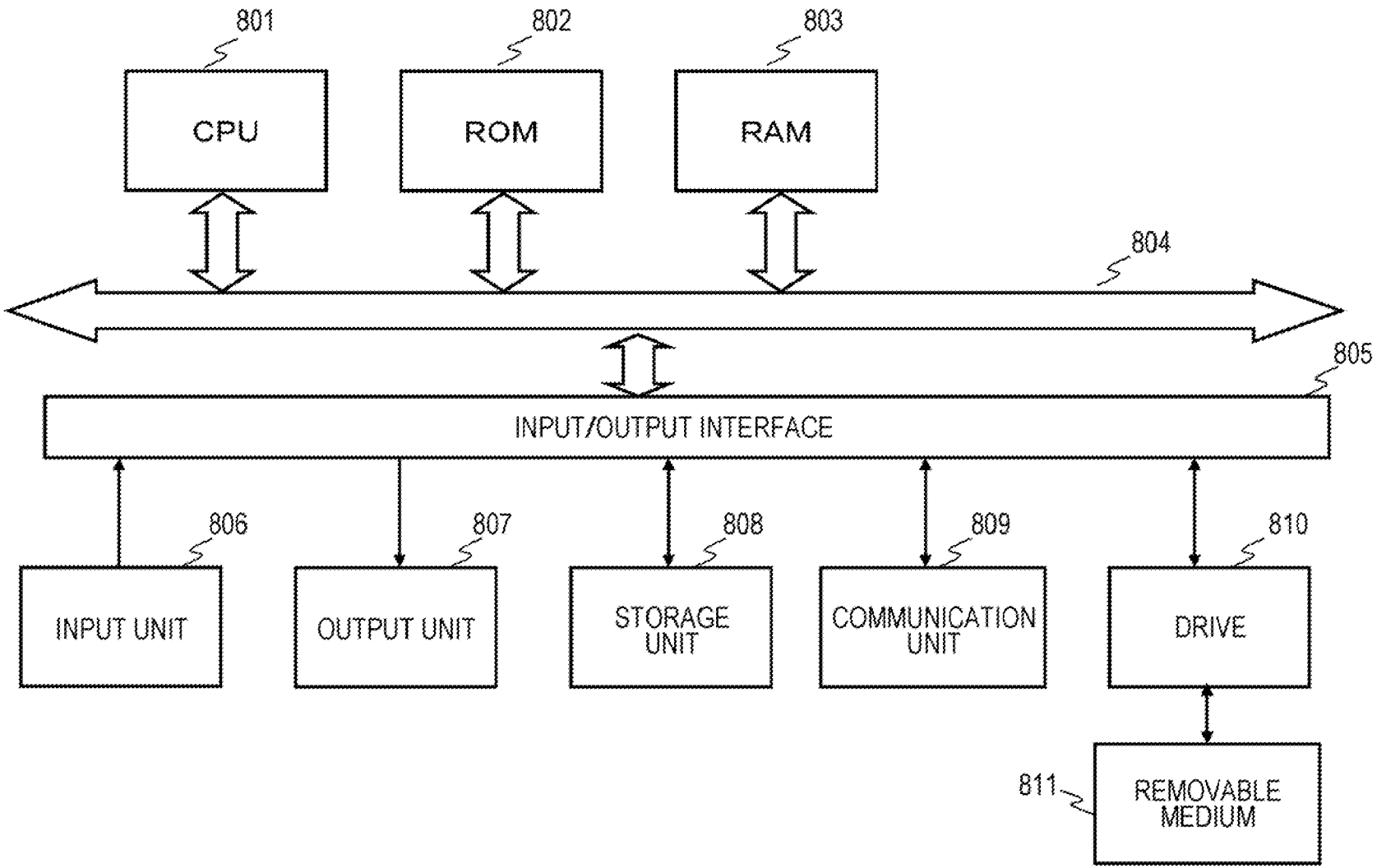

FIG. 31 illustrates an exemplary hardware configuration of a communication device applicable as the transmission device 20 and the reception device 30.

A central processing unit (CPU) 801 functions as a data processing unit that performs various processes according to programs stored in a read only memory (ROM) 802 or a storage unit 808.

For example, the CPU 801 performs the processes according to the sequences described in the above embodiment.

A random access memory (RAM) 803 stores programs executed by the CPU 801, data, and the like. The CPU 801, the ROM 802, and the RAM 803 are connected to one another via a bus 804.

The CPU 801 is connected to an input/output interface 805 via a bus 804, and an input unit 806 including various switches, a keyboard, a mouse, a microphone, and the like and an output unit 807 including a display, a speaker, and the like are connected to the input/output interface 805. The CPU 801 performs various processes in response to commands input from the input unit 806, and outputs processing results to, for example, the output unit 807.

A storage unit 808 connected to the input/output interface 805 is configured with, for example, a hard disk or the like, and stores programs performed by the CPU 801 and various data. A communication unit 809 functions as a transceiving unit for data communication via a network such as the Internet or a local area network (LAN) and a transceiving unit for broadcast waves, and communicates with an external device.

A drive 810 connected to the input/output interface 805 drives a removable medium 811 such as a magnetic disk, an optical disk, a magneto-optical disk, a semiconductor memory such as a memory card, and performs recording or reading of data.

Note that encoding or decoding of data can be performed as a process of the CPU 801 serving as the data processing unit, but a codec serving as dedicated hardware for executing an encoding process or a decoding processing may be provided.

[11. Summary of Configuration of Present Disclosure]

The embodiment of the present disclosure has been described in detail with reference to the specific examples. However, it is obvious that those skilled in the art can make modifications or substitutions of the embodiment without departing from the gist of the present disclosure. In other words, the embodiment is intended to disclosure the present invention an exemplary form and not intended to be interpreted in a limiting manner. In order to determine the gist of the present disclosure, claims set forth below should be taken into consideration.

Note that the technology disclosed in this specification may have the following configurations.

(1) A reception device, including:

a data processing unit that receives signaling data in which class information indicating a group of reception devices or users that are permitted to perform data reception via a network is recorded and determines whether the data reception is performed via broadcasting or via a network according to the class information.

(2) The reception device according to (1), wherein a class identifier is recorded in the signaling data, the data processing unit determines whether the class identifier recorded in the signaling data is identical to a class identifier which is assigned to the reception device or the user in advance, and the data reception is performed via the network when the class identifier recorded in the signaling data is identical to the class identifier which is assigned to the reception device or the user in advance.

(3) The reception device according to (1) or (2), wherein a class identifier is recorded in the signaling data, the data processing unit determines whether or not the class identifier recorded in the signaling data is identical to a class identifier which is assigned to the reception device or the user in advance, and the data reception is performed via the broadcasting when the class identifier recorded in the signaling data is not identical to the class identifier which is assigned to the reception device or the user in advance.

(4) The reception device according to any one of (1) to (3), wherein a URL base pattern serving as data access information applied to data reception via a broadcast wave or a network is recorded in the signaling data, and the data processing unit applies a URL base pattern which is acquirable from the signaling data and performs data acquisition.

(5) The reception device according to any one of (1) to (4), wherein a class identifier and a URL base pattern serving as data access information applied to data reception via a broadcast wave or a network are recorded in the signaling data, the data processing unit determines whether or not the class identifier recorded in the signaling data is identical to a class identifier which is assigned to the reception device or the user in advance, and when the class identifier recorded in the signaling data is identical to the class identifier which is assigned to the reception device or the user in advance, the URL base pattern which is recorded in the signaling data and applied to the data reception via the network is applied, and data acquisition via the network is performed.

(6) The reception device according to any one of (1) to (5), wherein the reception device is able to receive two types of signaling data of first signaling data in which the class information is recorded and second signaling data in which the class information is not recorded, and the data processing unit determines whether or not the class identifier recorded in the first signaling data in which the class information is recorded is identical to a class identifier which is assigned to the reception device or the user in advance, and when the class identifier recorded in the first signaling data in which the class information is recorded is identical to the class identifier which is assigned to the reception device or the user in advance, the URL base pattern which is recorded in the first signaling data and applied to the data reception via the network is applied, and the data acquisition via the network is performed.

(7) The reception device according to (6), wherein the data processing unit determines whether or not the class identifier recorded in the first signaling data in which the class information is recorded is identical to a class identifier which is assigned to the reception device or the user in advance, and when the class identifier recorded in the first signaling data in which the class information is recorded is not identical to the class identifier which is assigned to the reception device or the user in advance, the URL base pattern which is recorded in the second signaling data and applied to the data reception via the broadcasting is applied, and the data acquisition via the broadcasting is performed.

(8) The reception device according to any one of (1) to (7), wherein the reception device receives signaling data of a different setting according to a time zone, class information being recorded in the signaling data, and a reception path is changed on the basis of the signaling data of the different setting received according to the time zone.

(9) The reception device according to any one of (1) to (8), wherein the signaling data in which the class information is recorded is user service description (USD), and the data processing unit determines whether the data reception is performed via the broadcasting or via the network with reference to the user service description (USD).

(10) The reception device according to any one of (1) to (9), wherein the signaling data in which the class information is recorded is data in a delivery method (deliveryMethod) element set in user service description (USD), and the data processing unit determines whether the data reception is performed via the broadcasting or via the network with reference to the delivery method (deliveryMethod) element of the user service description (USD).

(11) The reception device according to any one of (1) to (10), wherein the class is a class set on the basis of a region of the reception device or the user or registration information of the reception device or the user.

(12) The reception device according to any one of (1) to (11), wherein a middleware constituting the data processing unit of the reception device determines whether the data reception is performed via the broadcasting or via the network according to the class information.

(13) The reception device according to any one of (1) to (12), wherein the signaling data in which the class information is recorded is signaling data in which data delivery information related to data serving as a management target of a specific service worker (SW) which is a data management program is recorded, and the data processing unit determines whether reception of the data serving as the management target of the service worker (SW) is performed via the broadcasting or via the network.

(14) The reception device according to any one of (1) to (13), wherein an application executed in the data processing unit of the reception device outputs a data acquisition request to the middleware that processes reception data, and in response to the data acquisition request, the middleware analyzes the signaling data in which the class information is recorded, and determines whether the data reception is performed via the broadcasting or via the network according to the class information obtained as an analysis result.

(15) A transmission device that transmits signaling data in which class information indicating a group of reception devices or users that are permitted to perform data reception via a network is recorded.

(16) The transmission device according to (15), wherein the signaling data is signaling data in which a class identifier of the reception device or the user that is permitted to perform the data reception via the network and a URL base pattern serving as data access information applied to data reception via a broadcast wave or via a network are recorded.

(17) A data processing method performed in a reception device, including:

receiving, by a communication unit, signaling data in which class information indicating a group of reception devices or users that are permitted to perform data reception via a network is recorded; and determining, by a data processing unit, whether the data reception is performed via broadcasting or via a network according to the class information.

(18) A data processing method performed in a transmission device, including:

transmitting signaling data in which class information indicating a group of reception devices or users that are permitted to perform data reception via a network is recorded.

Further, a series of processes described in the specification can be performed by hardware, software, or a complex configuration of both. When a process is performed by software, it is possible to install a program having a process sequence recorded therein in a memory in a computer incorporated into dedicated hardware and perform the program, or it is possible to install the program in a general-purpose computer capable of executing various processes and perform the program. For example, the program may be recorded in a recording medium in advance. The program may be installed in a computer from a recording medium, and the program may be received via a network such as the Internet or a LAN and installed in a recording medium such as an internal hard disk.

Note that various processes described in the specification may be performed not only chronologically according to the description but also in parallel or individually depending on a processing capability of a device that performs the processes or as necessary. Further, in this specification, a system is a logical aggregate configuration of a plurality of devices, and it is not limited to a configuration in which devices of respective components are in the same housing.

INDUSTRIAL APPLICABILITY

As described above, according to a configuration of an embodiment of the present disclosure, a configuration in which a reception device can determine whether or not data reception via a network is permitted on the basis of signaling data is implemented.

Specifically, for example, a class identifier indicating a group of reception devices or users that are permitted to perform data reception via a network is recorded in signaling data transmitted from a transmission device to a reception device.

A reception device determines whether or not a class identifier is identical to a class identifier set to a reception device or a user and performs data reception via a network when the class identifiers are identical to each other. A URL base pattern applied to data reception via a broadcast wave or a network is recorded in signaling data, and a reception device performs data acquisition to which the URL base pattern is applied.

According to the present configuration, a configuration in which a reception device can determine whether or not data reception via a network is permitted on the basis of signaling data is implemented.

REFERENCE SIGNS LIST

10 Communication system
20 Transmission device
21 Broadcast server
22 Data delivery server
30 Reception device
31 TV
32 PC
33 Mobile terminal
50 Signaling data
60 AV segment
70 Other data
110 Middleware
111 Communication unit (PHY/MAC)
112 Signaling acquiring unit
113 Signaling analyzing unit
114 File acquiring unit
120 HTTP proxy server
121, 122 Cache unit
123 Address resolution unit
130 Output control unit
131 Display data (for example, HTML/JavaScript (registered trademark)) acquisition & analysis unit
132 Display processing unit (renderer)
133 Storage unit (permanent cache)
140 External device
141 Output control unit
142 Storage unit (permanent cache)
751 Data processing unit
752 Communication unit
753 Storage unit
771 Data processing unit
772 Communication unit
773 Storage unit
774 Input unit
775 Output unit
801 CPU
802 ROM
803 RAM
804 Bus
805 Input/output interface
806 Input unit
807 Output unit
808 Storage unit
809 Communication unit
810 Drive
811 Removable medium

The invention claimed is:

1. A reception device, comprising:

circuitry configured to receive signaling data comprising a deliveryMethod element including at least one of a first element corresponding to a broadcast delivered application file and a second element corresponding to a network delivered application file, determine a data delivery path of accessing the broadcast delivered application file or the network delivered application file based on a reception status of the reception device and based on whether one or both of the first element and the second element are present in the deliveryMethod element of the received signaling data, and access only one of the broadcast delivered application file corresponding to the first element and the network delivered application file corresponding to the second element based on the determined data delivery path, wherein the signaling data includes class information including a class identifier indicating a group of reception devices or users that are permitted to access the network delivered application file, and the data delivery path is determined according to the class information, based on a comparison, in the reception device, of the class identifier included in the signaling data to a class setting stored in advance in the reception device.

2. The reception device according to claim 1, wherein the circuitry is further configured to determine whether or not the class identifier included in the signaling data is identical to a class identifier which is assigned to the reception device or a user in advance, and access only the broadcast delivered application file when the class identifier included in the signaling data is not identical to the class identifier which is assigned to the reception device or the user in advance.

3. The reception device according to claim 1, wherein a Universal Resource Locator (URL) base pattern serving as data access information is included in the signaling data, and the circuitry is further configured to apply the URL base pattern and access only the broadcast delivered application file or only the network delivered application file.

4. The reception device according to claim 1, wherein the signaling data further includes a URL base pattern serving as data access information, the circuitry is further configured to determine whether or not the class identifier included in the signaling data is identical to a class identifier which is assigned to the reception device or a user in advance, and access only the network delivered application file based on the URL base pattern when the class identifier included in the signaling data is identical to the class identifier which is assigned to the reception device or the user in advance.

5. The reception device according to claim 1, wherein the circuitry is further configured to receive two types of the signaling data, the two types of the signaling data including first signaling data which includes the class information and second signaling data which does not include the class information, and determine whether or not a class identifier included in the first signaling data is identical to another class identifier which is assigned to the reception device or a user in advance, and when the class identifier included in the first signaling data in which the class information is identical to the another class identifier which is assigned to the reception device or the user in advance, access only the network delivered application file based on a URL base pattern included in the first signaling data.

6. The reception device according to claim 5, wherein when the class identifier included in the first signaling data is not identical to the another class identifier which is assigned to the reception device or the user in advance, the circuitry is further configured to access only the broadcast delivered application file based on another URL base pattern included in the second signaling data.

7. The reception device according to claim 1, wherein the circuitry is further configured to receive signaling data of a different setting according to a time zone, and the data delivery path is changed based on the signaling data of the different setting received according to the time zone.

8. The reception device according to claim 1, wherein the signaling data is a user service description (USD) and the circuitry is further configured to access only the broadcast delivered application file or only the network delivered application file with reference to the USD.

9. The reception device according to claim 1, wherein the deliveryMethod element is set in a user service description (USD), and the circuitry is further configured to access only the broadcast delivered application file or only the network delivered application file with reference to the deliveryMethod element set in the USD.

10. The reception device according to claim 1, wherein a class included in the class information is set based on a region of the reception device or a user, or based on registration information of the reception device or the user.

11. The reception device according to claim 1, wherein a middleware constituting the circuitry of the reception device determines whether to access only the broadcast delivered application file or only the network delivered application file based on the determined data delivery path.

12. The reception device according to claim 1, wherein the data delivery path is related to a data delivery path of data serving as a management target of a specific service worker (SW), the SW being a data management program, and the circuitry is further configured to determine whether reception of the data serving as the management target of the SW is performed via broadcasting or via a network.

13. The reception device according to claim 1, wherein an application executed in the circuitry of the reception device outputs a data acquisition request to a middleware that processes reception data, and in response to the data acquisition request, the middleware analyzes the signaling data, and determines whether to access only the broadcast delivered application file or the network delivered application file according to an analysis result of the signaling data.

14. The reception device according to claim 1, wherein the data delivery path is changed based on a condition of the determined data delivery path.

15. The reception device according to claim 9, wherein the USD includes a first Universal Resource Locator (URL) corresponding to the broadcast delivered application file and a second URL corresponding to the network delivered application file.

16. The reception device according to claim 1, wherein the first element and the second element are on a hierarchical level directly below the deliveryMethod element.

17. A transmission device, comprising:

a transmitter configured to transmit signaling data to a reception device, the signaling data comprising a deliveryMethod element including at least one of a first element corresponding to a broadcast delivered application file and a second element corresponding to a network delivered application file, wherein a data delivery path of accessing the broadcast delivered application file or the network delivered application file is determined based on a reception status of the reception device and based on whether one or both of the first element and the second element are present in the deliveryMethod element of the transmitted signaling data, and only one of the broadcast delivered application file corresponding to the first element and the network delivered application file corresponding to the second element is accessed by the reception device based on the determined data delivery path, the signaling data includes class information including a class identifier indicating a group of reception devices or users that are permitted to access the network delivered application file, and the data delivery path is determined according to the class information, based on a comparison, in the reception device, of the class identifier included in the signaling data to a class setting stored in advance in the reception device.

18. A data processing method performed in a reception device, comprising:

receiving, by circuitry of the reception device, signaling data comprising a deliveryMethod element including at least one of a first element corresponding to a broadcast delivered application file and a second element corresponding to a network delivered application file;

determining, by the circuitry of the reception device, a data delivery path of accessing the broadcast delivered application file or the network delivered application file based on a reception status of the reception device and based on whether one or both of the first element and the second element are present in the deliveryMethod element of the received signaling data; and accessing, by the circuitry of the reception device, only one of the broadcast delivered application file corresponding to the first element and the network delivered application file corresponding to the second element based on the determined data delivery path, wherein the signaling data includes class information including a class identifier indicating a group of reception devices or users that are permitted to access the network delivered application file, and the data delivery path is determined according to the class information, based on a comparison, in the reception device, of the class identifier included in the signaling data to a class setting stored in advance in the reception device.

19. A data processing method performed in a transmission device, comprising:

transmitting signaling data to a reception device, the signaling data comprising a deliveryMethod element including at least one of a first element corresponding to a broadcast delivered application file and a second element corresponding to a network delivered application file, wherein a data delivery path of accessing the broadcast delivered application file or the network delivered application file is determined based on a reception status of the reception device and based on whether one or both of the first element and the second element are present in the deliveryMethod element of the transmitted signaling data, and only one of the broadcast delivered application file corresponding to the first element and the network delivered application file corresponding to the second element is accessed by the reception device based on the determined data delivery path, the signaling data includes class information including a class identifier indicating a group of reception devices or users that are permitted to access the network delivered application file, and the data delivery path is determined according to the class information, based on a comparison, in the reception device, of the class identifier included in the signaling data to a class setting stored in advance in the reception device.

* * * * *